US009159285B2

(12) United States Patent
Chang et al.

(10) Patent No.: US 9,159,285 B2
(45) Date of Patent: Oct. 13, 2015

(54) DISPLAY DEVICE HAVING REPAIR STRUCTURE

(71) Applicant: LG Display Co., Ltd., Seoul (KR)

(72) Inventors: MinKyu Chang, Paju-si (KR); JongSik Shim, Goyang-si (KR); Jeongpyo Lee, Suwon-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/324,919

(22) Filed: Jul. 7, 2014

(65) Prior Publication Data

US 2015/0154899 A1 Jun. 4, 2015

(30) Foreign Application Priority Data

Dec. 2, 2013 (KR) ..... 10-2013-0148487

(51) Int. Cl.
*G09G 3/32* (2006.01)
*G09G 3/36* (2006.01)

(52) U.S. Cl.
CPC ..... *G09G 3/3648* (2013.01); *G09G 3/3233* (2013.01); *G09G 2300/0404* (2013.01); *G09G 2300/0819* (2013.01); *G09G 2300/0842* (2013.01); *G09G 2320/045* (2013.01); *G09G 2330/08* (2013.01)

(58) Field of Classification Search
CPC ..... G09G 2330/08
See application file for complete search history.

(56) References Cited

U.S. PATENT DOCUMENTS

2007/0152567 A1* 7/2007 Yao ..... G09G 3/3233 313/504
2013/0147773 A1* 6/2013 Jin ..... G09G 3/30 345/204

* cited by examiner

*Primary Examiner* — Gerald Johnson
*Assistant Examiner* — Christopher Kohlman
(74) *Attorney, Agent, or Firm* — Fenwick & West LLP

(57) ABSTRACT

A display device having a repair structure that makes a defective pixel operate as a normal pixel in a display panel.

17 Claims, 25 Drawing Sheets

(A)

(B)

PROGRAM STEP

STAND BY STEP

DISPLAY DEVICE HAVING REPAIR STRUCTURE

CROSS-REFERENCE TO RELATED APPLICATION

This application claims priority from and the benefit under 35 U.S.C. §119(d) of Korean Patent Application No. 10-2013-0148487, filed Dec. 2, 2013, which is hereby incorporated by reference for all purposes as if fully set forth herein.

BACKGROUND OF THE INVENTION

1. Field of the Invention

The present invention relates to a display device having a transistor structure.

2. Description of the Prior Art

At least one transistor for image displaying is disposed at each pixel of a display panel for a display device such as a Liquid Crystal Display (LCD), an Organic Light Emitting Display (OLED), etc.

Because such a transistor within each pixel of the display panel is manufactured through various processes, the transistor does not normally operate due to minute foreign substances generated during the processes, so that a problem may occur in which the corresponding pixel is lightened or blackened.

The lightened or blackened defective pixel degrades fabrication yield and increases manufacturing costs of the display panel.

Thus, in the related art, a repair process is performed in which the defective pixel lightened due to the impure materials generated during the processes is blackened and does not operate as a normal pixel so as not to be visually recognized well.

However, when the number of the blackened pixels increases due to the related repair process, the display panel may not be used so that the display panel is discarded. Further, a particularly effective repair process cannot be currently performed with respect to the blackened defective pixel.

SUMMARY OF THE INVENTION

In such a background, an aspect of the present invention is to provide a display device with a repair structure which makes a defective pixel operate as a normal pixel.

Further, another aspect of the present invention is to provide a display device in which a luminance of the defective pixel is compensated after a repair process which makes the defective pixel operate as a normal pixel.

In accordance with an aspect of the present invention, a display device is provided. The display device includes: a display panel in which a plurality of pixels in which a data line and a gate line are formed are defined; a data driving unit configured to supply a data voltage to the data line; and a gate driving unit configured to supply a scan signal to the gate line, wherein a pixel from the plurality of pixels includes a first transistor; a second transistor; a first welding pattern spaced apart from at least one of a source node and a drain node of the first transistor; and a second welding pattern spaced apart from at least one of a source node and a drain node of the second transistor.

The first transistor and the second transistor may be connected to each other in series and perform a switching operation together.

The pixel may include a connection pattern for connecting the source node and the drain node of one of the first transistor and the second transistor.

In one aspect, the connection pattern is formed by welding one of the first welding pattern and the second welding pattern, and one of the first transistor and the second transistor performs a switching operation.

In accordance with another aspect of the present invention, a display device is provided. The display device includes: a display panel in which a plurality of pixels in which a data line and a gate line are formed are defined; a data driving unit configured to supply a data voltage to the data line; and a gate driving unit configured to supply a scan signal to the gate line, wherein a pixel from the plurality of pixels includes: a first transistor; a second transistor; and a welding pattern, and wherein a drain node of the first transistor is coupled to a drain node of the second transistor, and a source node of the first transistor is coupled to a source node of the second transistor, and the welding pattern is coupled to the second transistor in series to disable current to flow through the second transistor.

The welding pattern may be formed at the drain node or the source node of the second transistor.

In one approach, at least the drain node and the source node of the first transistor is cut, and a connection pattern is formed on the welding pattern to enable the second transistor to conduct current.

The connection pattern may be formed by welding the welding pattern.

In one example, a size of the second transistor is smaller than a size of the first transistor.

As described above, in accordance with the present invention, a display device with a repair structure which makes a defective pixel operate as a normal pixel is provided.

Further, in accordance with the present invention, a display device, in which a luminance of the defective pixel is compensated after a repair process which makes the defective pixel operate as a normal pixel, is provided.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Figure 1:
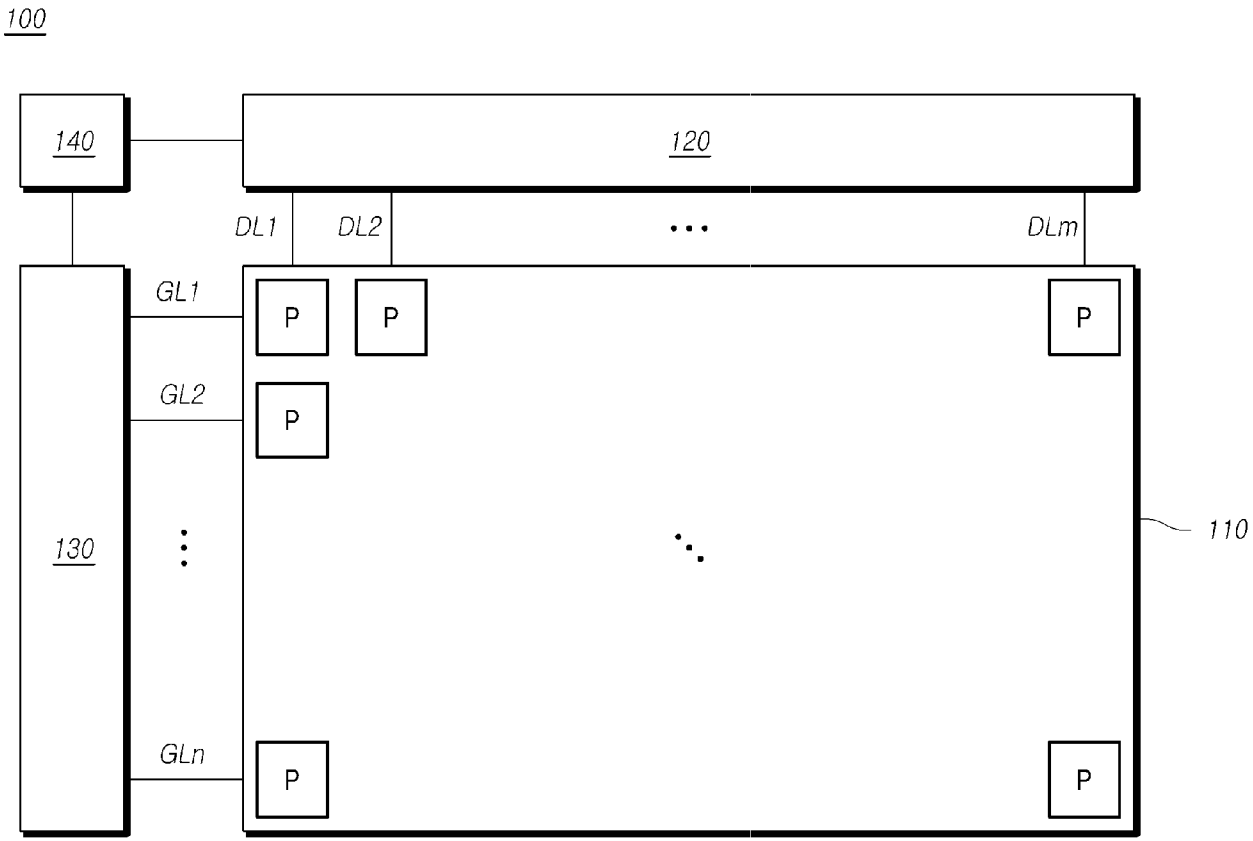
FIG. 1 schematically illustrates a system of a display device to which embodiments are applied.

Hereinafter, exemplary embodiments of the present invention will be described with reference to the accompanying drawings. In designating elements of the drawings by reference numerals, the same elements will be designated by the same reference numerals although they are shown in different drawings. Further, in the following description of the present invention, a detailed description of known functions and configurations incorporated herein will be omitted when it may make the subject matter of the present invention rather unclear.

In addition, terms, such as first, second, A, B, (a), (b) or the like may be used herein when describing components of the present invention. These terms are merely used to distinguish one element from another element, and do not limit a true nature, a sequence, an order, the number, etc. of the corresponding element. In the case that it is written that one component "is connected to", "is coupled with", or "is in contact with" another component, it should be interpreted that a third component may "be interposed" between the one component and the another component or the one component may "be connected to", "be coupled with", or "be in contact with" the another component through the third component although the one component may be directly connected to or be in direct contact with the another component.

FIG. 1 schematically illustrates a system of a display device 100 to which embodiments are applied.

Referring to FIG. 1, the display device 100 to which embodiments are applied includes a display panel 110 in which a plurality of data lines DL1 to DLm and a plurality of gate lines GL1 to GLn are formed so as to define a plurality of pixels, a data driving unit 120 for supplying a data voltage to the plurality of data lines DL1 to DLm, a gate driving unit 130 for supplying a scan signal to the plurality of gate lines GL1 to GLn, a timing controller 140 for controlling driving timing of the data driving unit 120 and the gate driving unit 130, etc.

Although such a display device 100 may correspond to an LCD, an OLED, etc., each pixel of the display device 100 may necessarily include one or more transistor, regardless of a type of the display device 100.

In the present embodiments, each pixel includes a first transistor T1, and further includes a second transistor T2 disposed with the first transistor T1 in a "series structure" or in a "parallel structure".

In the present embodiments, that the first transistor T1 and the second transistor T2 are disposed in the "series structure" or in the "parallel structure" implies that the first transistor T1 and the second transistor T2 are connected to each other in series or in parallel on a circuit, or, in some cases, that although the first transistor T1 and the second transistor T2 are not fully connected to each other in series or in parallel on a circuit, the first transistor T1 and the second transistor T2 are disposed to be partially connected to each other while a part of the circuit is disconnected or opened.

In the present embodiments, when both of the first transistor T1 and the second transistor T2 within each pixel are in a normal state, both of the first transistor T1 and the second transistor T2 operate or one of the first transistor T1 and the second transistor T2 operates. Further, when a problem occurs in one of the first transistor T1 and the second transistor T2 so that the corresponding pixel becomes a defective pixel, the other one of the first transistor T1 and the second transistor T2 operates so that the corresponding pixel is repaired from the lightened or blackened defective pixel to a normal pixel.

In more detail, in a case where the first transistor T1 and the second transistor T2 are disposed in the series structure, when both of the first transistor T1 and the second transistor T2 operate as a switching element and a problem then occurs in the first transistor T1, only the second transistor T2 operates as a switching element so that the corresponding pixel is repaired from the defective pixel to a normal pixel.

Further, in a case where the first transistor T1 and the second transistor T2 are disposed in the parallel structure, when a total current supplied to the first transistor T1 and the second transistor T2 is conducted only to the first transistor T1 and a problem then occurs in the first transistor T1, the total current is conducted only to the second transistor T2 so that the corresponding pixel is repaired from the defective pixel to a normal pixel.

Thus, it can be seen that one of the first transistor T1 and the second transistor T2 is substituted for both or the other one of the first transistor T1 and the second transistor T2. In particular, when the first transistor T1 and the second transistor T2 are disposed in the parallel structure, the second transistor T2 corresponds to a redundancy transistor of the first transistor T1, which completely performs a function performed by the first transistor T1 before the problem occurs, instead of the first transistor T1.

Hereinafter, referring to FIG. 2, a repair transistor structure will be described by which a defective pixel is repaired to a normal pixel when a problem (situation where a circuit does not operate or malfunctions according to short or circuit-disconnection caused by impure materials generated during the manufacturing processes, etc.) occurs in one of the first transistor T1 and the second transistor T2 causing the corresponding pixel to be defective (e.g., lightened or blackened).

The "repair transistor structure" in the present embodiments implies a "transistor structure" by which a defective pixel can be repaired to a normal pixel.

Figure 2:
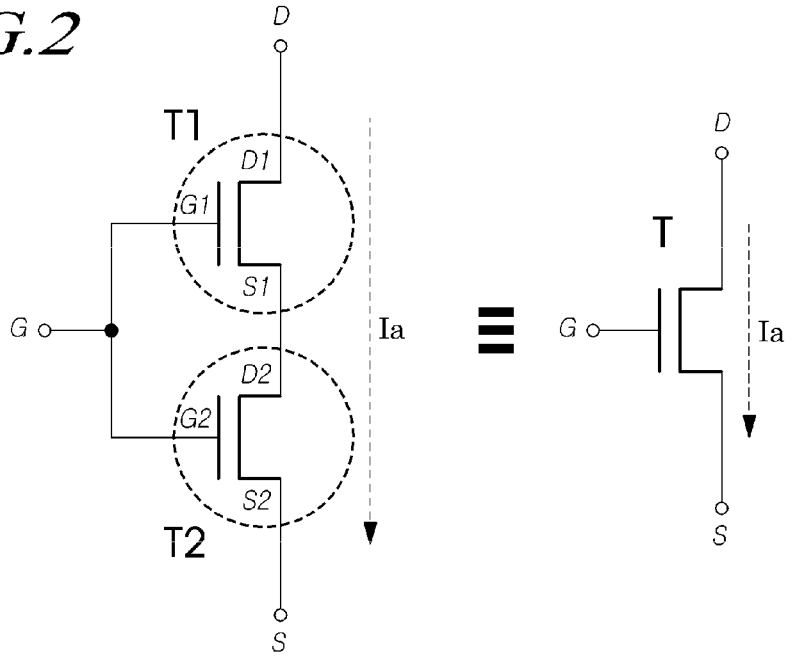
FIG. 2 illustrates a repair transistor structure according to an embodiment in part (A) and a repair transistor structure according to another embodiment in part (B)
Figure 2:
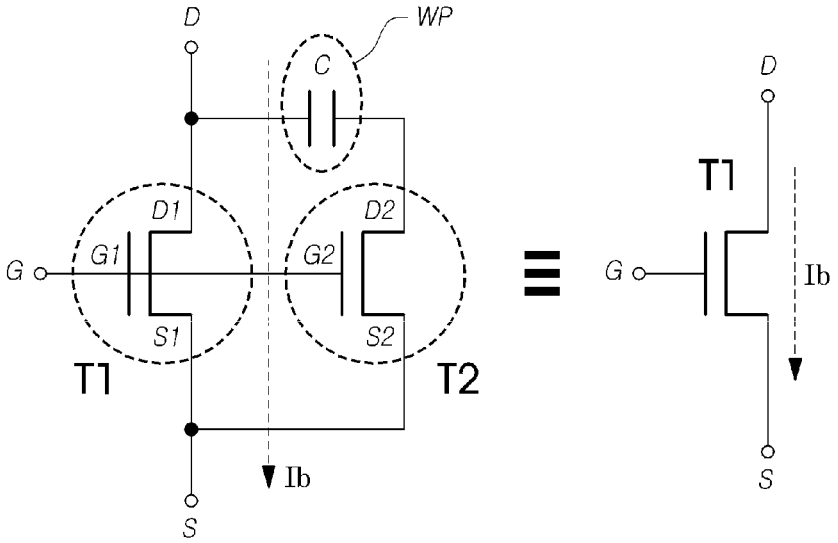

FIG. 2 illustrates a repair transistor structure according to an embodiment in part (A) and a repair transistor structure according to another embodiment in part (B).

FIG. 2, part (A) illustrates a repair transistor structure according to an embodiment, which corresponds to a transistor structure in which the first transistor T1 and the second transistor T2 are disposed in a series structure.

Referring to FIG. 2, part (A), in the repair transistor structure according to an embodiment, a gate node G1 of the first transistor T1 and a gate node G2 of the second transistor T2 are integrally connected to each other, and a source node S1 of the first transistor T1 and a drain node D2 of the second transistor T2 are connected to each other, so that the first transistor T1 and the second transistor T2 are disposed in a series structure. Herein, the source nodes and the drain nodes of the transistors T1 and T2 may be reversely configured according to types (N-type or P-type) of transistors or characteristics of the circuit.

Referring to FIG. 2, part (A), when both of the first transistor T1 and the second transistor T2 are turned on by a gate signal simultaneously applied to the gate node G1 of the first transistor T1 and a gate node G2 of the second transistor T2, a current Ia flows from a drain node D1 of the first transistor T1 to a source node S2 of the second transistor T2.

Referring to FIG. 2, part (A), the first transistor T1 and the second transistor T2 which are connected to each other in series may be represented as an equivalent transistor T. In FIG. 2, part (A), a G node, a D node and an S node correspond to a gate node, a drain node and a source node of the equivalent transistor T, respectively.

FIG. 2, part (B) illustrates a repair transistor structure according to another embodiment, which corresponds to a transistor structure in which the first transistor T1 and the second transistor T2 are disposed in a parallel structure.

Referring to FIG. 2, part (B), in the repair transistor structure according to another embodiment, a gate node G1 of the first transistor T1 and a gate node G2 of the second transistor T2 are connected to one node G, and a source node S1 of the first transistor T1 and a source node S2 of the second transistor T2 are connected to one node S.

Meanwhile, a drain node D (herein also referred to as a "supply node D") is connected to a drain node D1 of the first transistor T1, and is connected to a drain node D2 of the second transistor T2 through a small capacitor C. A point where such a capacitor C is formed refers to a Welding Point (WP).

Herein, the source nodes and the drain nodes of the transistors T1 and T2 may be reversely configured according to types (N-type or P-type) of transistors or characteristics of the circuit.

Referring to FIG. 2, part (B), even when a gate signal is simultaneously applied to the gate node G1 of the first transistor T1 and the gate node G2 of the second transistor T2, only the first transistor T1 operates as a normal switching element for conducting a current Ib from the supply node D to the source node S (herein also referred to as an "output node S") of the equivalent transistor T, due to the capacitor C.

Thus, the transistors T1 and T2 may be represented as the first transistor T1.

Meanwhile, as long as only the first transistor T1 operates as a normal switching element for conducting the current Ib from the supply node D to the output node S, locations and the number of the small capacitors C may be determined in any manner that prevents the second transistor T2 from conducting current. For example, the small capacitor C may be formed between the drain node D2 of the second transistor T2 and the supply node D of the equivalent transistor T, between the source node S2 of the second transistor T2 and the output node S of the equivalent transistor T, or at both places.

In describing the repair transistor structure according to another embodiment, which is illustrated in FIG. 2, part (B), again, the first transistor T1 and the second transistor T2 are connected in parallel between a supply port D and an output port S, and a welding pattern such as a capacitor C, etc., which makes the second transistor T2 not conduct a current between the supply port D and the output port S, is formed.

FIG. 2 illustrates a connection structure and an operation state of the first transistor T1 and the second transistor T2 when the corresponding pixel is not a defective pixel but a normal pixel.

When the corresponding pixel is a lightened or blackened defective pixel, a repair process is performed such that the corresponding pixel operates as a normal pixel. The repair process for the pixel uses the above-described repair transistor structure.

Hereinafter, a repair process for the pixel having the repair transistor structure according to an embodiment will be described with reference to FIGS. 3 to 6, and a repair process for the pixel having the repair transistor structure according to another embodiment will be described with reference to FIG. 7.

Figure 3:
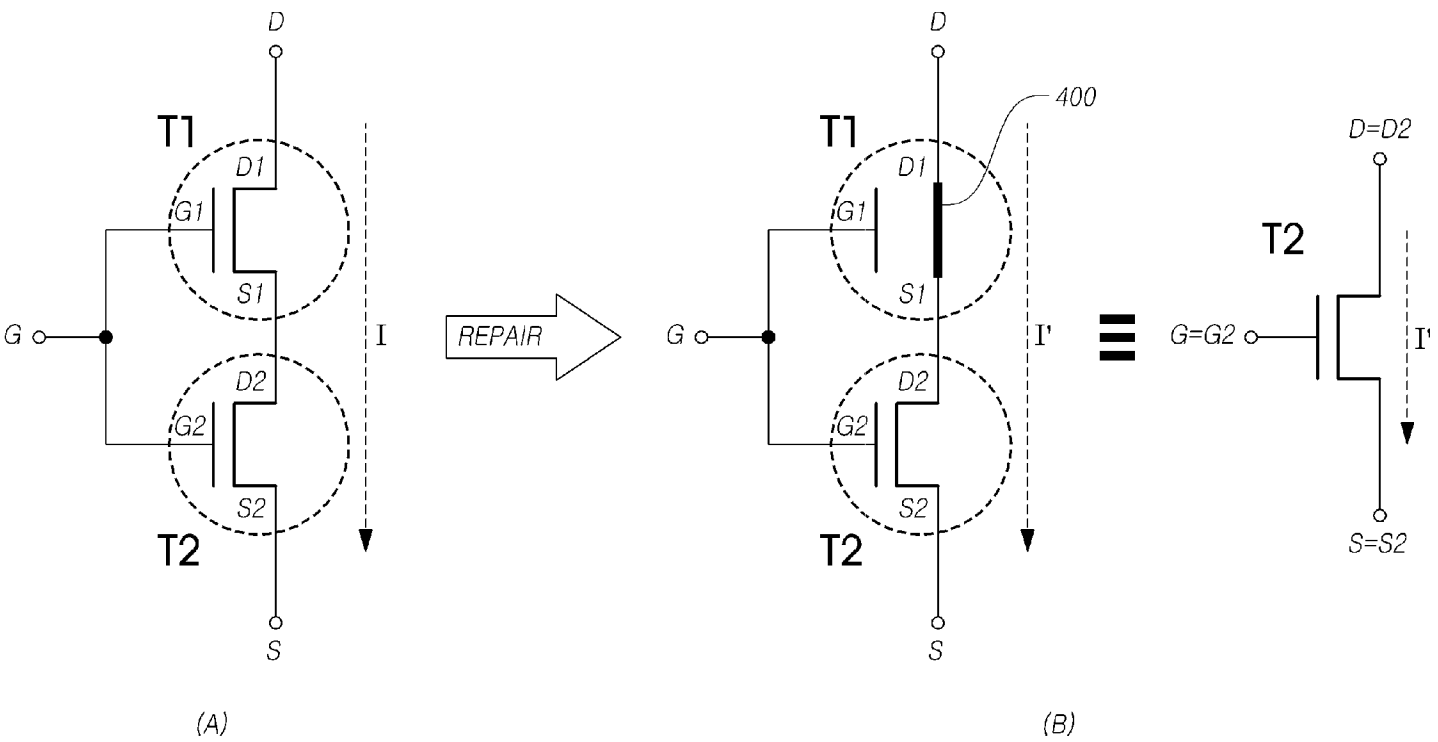
FIG. 3 illustrates a pixel having a repair transistor structure according to an embodiment, before a repair process in part (A) and after a repair process in part (B)

FIG. 3 illustrates a pixel having a repair transistor structure according to an embodiment, before a repair process in part (A) and after a repair process in part (B).

FIG. 3, part (A) illustrates a case where the pixel having the repair transistor structure according to an embodiment is in a normal state, and FIG. 3, part (B) illustrates a result obtained by performing the repair process on the corresponding pixel that is identified as a defective pixel.

Referring to FIG. 3, part (A), in a pixel having the repair transistor structure according to an embodiment of the present disclosure, the first transistor T1 and the second transistor T2 are connected to each other in series.

Referring to FIG. 3, part (A), since the pixel is in a normal state, the first transistor T1 and the second transistor T2 are turned on together by a gate signal which is commonly applied thereto, so that a current I flows through the first transistor T1 and the second transistor T2.

That is, in a pixel before the repair process is performed among the plurality of pixels, the first transistor T1 and the second transistor T2 are connected to each other in series, and operate as a switching element together.

When an impure material is generated during the manufacturing processes in one of the first transistor T1 and the second transistor T2 in the pixel and causes the pixel to become defective, the repair process is performed to make the pixel operate as a normal pixel.

The repair process of the pixel corresponds to that, in the repair transistor structure according to an embodiment, a source node and a drain node of a transistor, in which a problem is generated, between the first transistor T1 and the second transistor T2 in the pixel are shorted to each other such that the transistor operates not as a switching element but as a circuit connection line.

FIG. 3, part (B) illustrates a state in which the repair process is performed by shorting the drain node D1 and the source node S1 of the first transistor T1 to each other when a problem is generated in the first transistor T1 between the first transistor T1 and the second transistor T2.

In the repair-processed pixel among the plurality of pixels having the repair transistor structure according to an embodiment, the repair process is performed such that a transistor having a problem between the first transistor T1 and the second transistor T2 is shorted and the other transistor operates as a switching element.

Referring to an example of FIG. 3, part (B), when a problem is generated in the first transistor T1 in the pixel having the repair transistor structure according to an embodiment so that the corresponding pixel becomes a defective pixel, the repair process is performed by shorting the drain node D1 and the source node S1 of the first transistor T1 as a single conductor 400.

Accordingly, as illustrated in FIG. 3, part (B), after the repair process, the first transistor T1 and the second transistor T2 in the pixel having the repair transistor structure according to an embodiment can be represented as the second transistor T2.

Referring to FIG. 3, part (B), after the repair process of the pixel having the repair transistor structure according to an embodiment, only the second transistor T2 operates as a switching element and a current I' flows through the transistor T2. In this case, the current I' may be different from the current I flowing through the first transistor T1 and the second transistor T2 before the repair process.

That is, after the repair process of the pixel having the repair transistor structure according to an embodiment, the desired current I does not flow and the current I' lower than the current I flows, so that a decrease in luminance may be generated in the repair-processed pixel.

Thus, a sensing function and a compensation function which compensate for the decrease in the luminance with respect to the repair-processed pixel will be described with respect to FIGS. 16 to 23 in more detail.

As described above, in the repair-processed pixel among the plurality of pixels having the repair transistor structure according to an embodiment, a source node and a drain node of one of the first transistor T1 and the second transistor T2 are shorted to each other, and the other transistor operates as a switching element.

Hereinafter, the repair transistor structure and the repair process method which can perform the repair process by shorting the drain node D1 and the source node S1 of the first transistor T1 having a problem will be described with reference to FIGS. 4 to 6.

Figure 4:
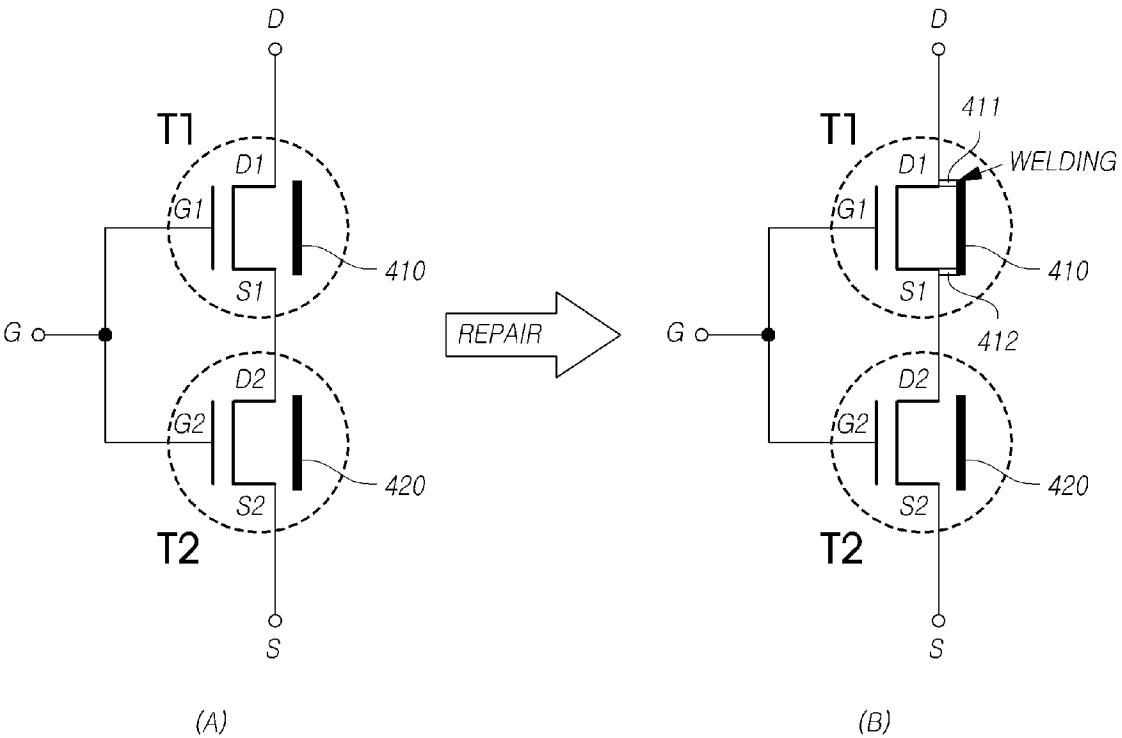
FIGS. 4 to 6 illustrate a pixel having a repair transistor structure according to an embodiment, before and after a repair process is performed by a laser welding process.
Figure 5:
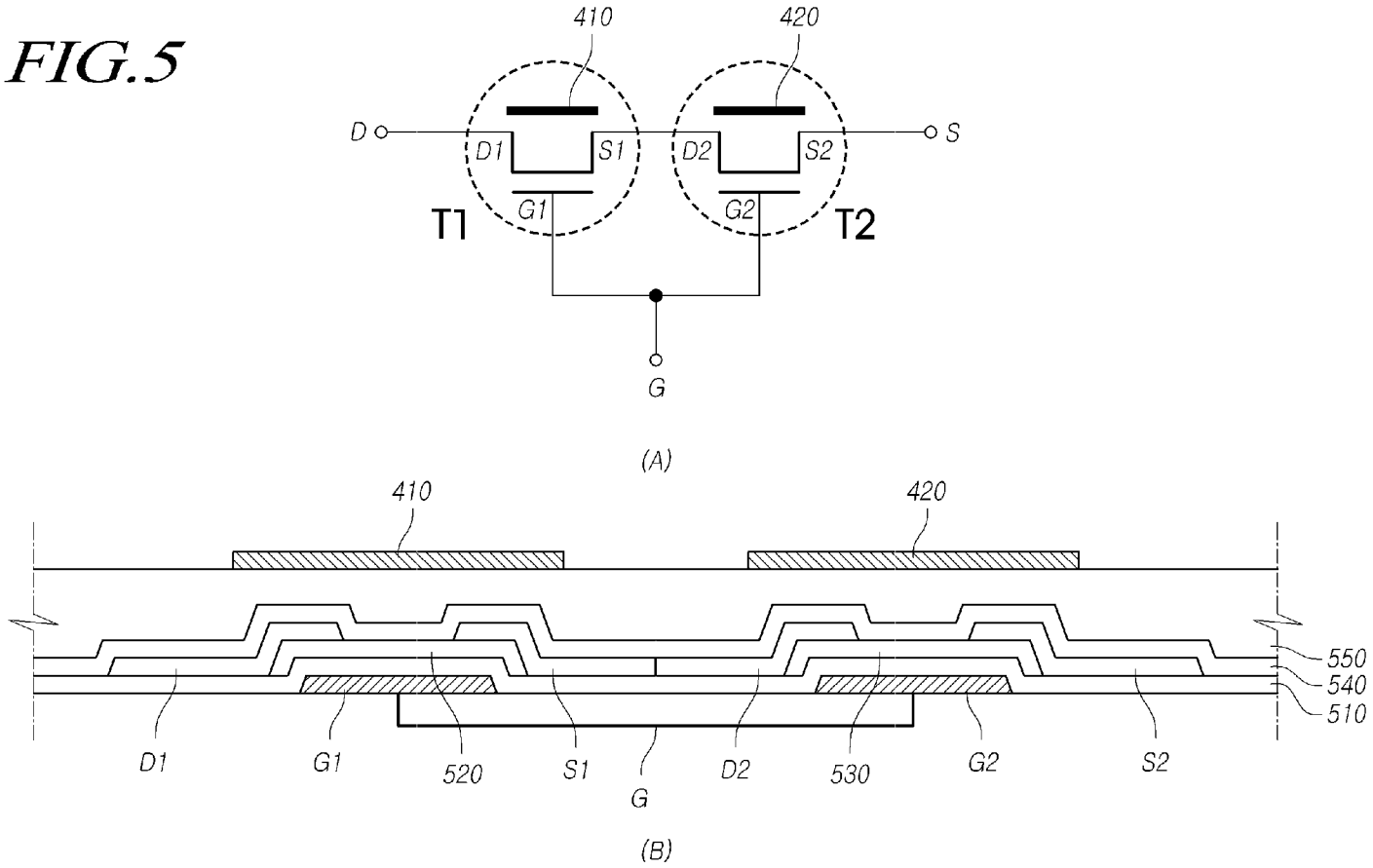
Figure 6:
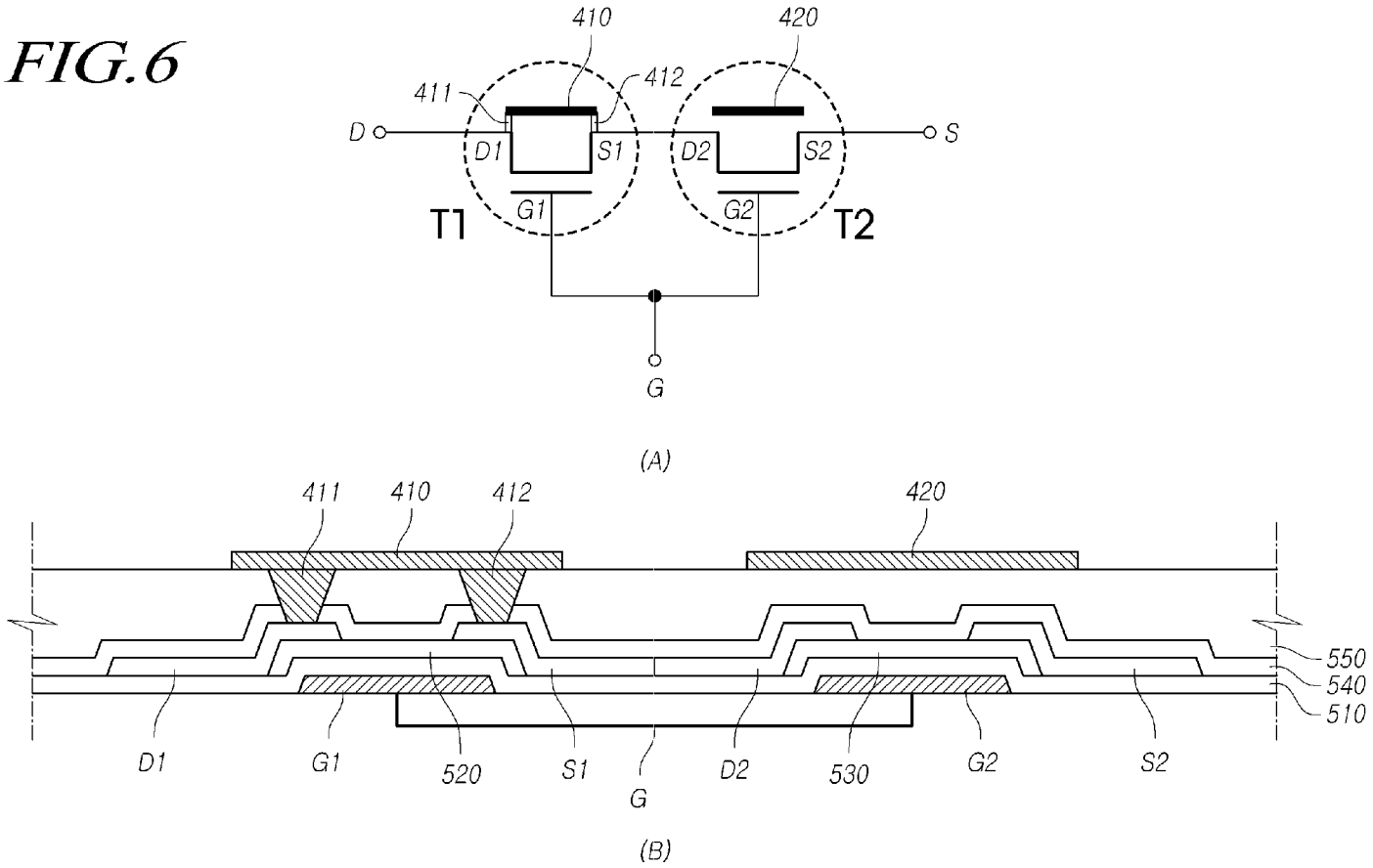

FIGS. 4 to 6 illustrate a pixel having a repair transistor structure according to an embodiment, before and after a repair process is performed by a laser welding process.

FIG. 4, part (A) illustrates a transistor structure before the pixel having the repair transistor structure according to an embodiment is repair-processed.

Referring to FIG. 4, part (A), in at least one pixel (i.e., pixel before the repair process) among the plurality of pixels having the repair transistor structure according to an embodiment, a first welding pattern 410 spaced apart from at least one of the source node S1 and the drain node D1 of the first transistor T1 is formed, and a second welding pattern 420 spaced apart from at least one of the source node S2 and the drain node D2 of the second transistor T2 is formed.

Meanwhile, there may be one or more other repair-processed pixels among the plurality of pixels having the repair transistor structure according to an embodiment. Further, in the one or more other repair-processed pixels, a connection pattern, which connects the source node and the drain node of one of the first transistor T1 and the second transistor T2 by welding one of the first welding pattern 410 and the second welding pattern 420 through a laser welding process which irradiates a laser beam, may be formed.

Referring to FIG. 4, part (B) which illustrates a case after the repair process is performed when a problem is generated in the first transistor T1 between the first transistor T1 and the second transistor T2, the first welding pattern 410 is welded through the laser welding process which irradiates a laser beam, so that a connection pattern which connects the source node S1 and the drain node D1 of the first transistor T1 is formed.

Referring to FIG. 4, part (B), the connection pattern may correspond to welding particles 411 and 412 formed between the source node S1 and the drain node D1 of the first transistor T1 and the first welding pattern 410 through the laser welding process, or a pattern including all of the first welding pattern 410 and the welding particles 411 and 412. Here, the welding particles 411 and 412 may correspond to a portion generated by changing a part of the welding pattern 410 through the laser welding process, or by changing a part of the source node S1 and the drain node D1 of the first transistor T1 through the laser welding process.

Accordingly, the first transistor T1 cannot operate as a switching element and becomes a single conductor, and only the second transistor T2 operates as a switching element.

FIG. 5, parts (A) and (B) are exemplary sectional views illustrating a state (FIG. 4, part (A)) before the pixel having the repair transistor structure according to an embodiment is repair-processed, and FIG. 6, parts (A) and (B) are exemplary sectional views illustrating a state (FIG. 4, part (B)) after the pixel having the repair transistor structure according to an embodiment is repair-processed. In FIGS. 5 and 6, a gate node, a drain node and a source node are illustrated as a gate electrode, a drain electrode and a source electrode, respectively.

Referring to FIG. 5, part (B), illustrated is an exemplary sectional view of the pixel having the repair transistor structure as shown in FIG. 5, part (A). The gate node G1 of the first transistor T1 and the gate node G2 of the second transistor T2 are formed, and a gate insulator 510 is formed to cover the gate node G1 of the first transistor T1 and the gate node G2 of the second transistor T2.

An activation layer 520 of the first transistor T1 and an activation layer 530 of the second transistor T2 are formed on the gate insulator 510.

After the activation layer 520 of the first transistor T1 and the activation layer 530 of the second transistor T2 are formed, a drain electrode D1 and a source electrode S1 of the first transistor T1 and a drain electrode D2 and a source electrode S2 of the second transistor T2 are formed thereon. Here, the source electrode S1 of the first transistor T1 and the drain electrode D2 of the second transistor T2 are formed as one electrode.

In order to protect the first transistor T1 and the second transistor T2 formed in this way, a passivation layer 540 and an overcoat layer 550 are formed thereon.

Referring to FIG. 5, part (B), the first welding pattern 410 for shorting the first transistor T1 and the second welding pattern 420 for shorting the second transistor T2 are formed on the overcoat layer 550.

The first welding pattern 410 may be formed to be spaced apart from the source electrode S1 and the drain electrode D1 of the first transistor T1, and may be formed to have a length corresponding to a distance between the source electrode S1 and the drain electrode D1 in order to short the source electrode S1 and the drain electrode D1.

Further, The second welding pattern 420 may be formed to be spaced apart from the source electrode S2 and the drain electrode D2 of the second transistor T2, and may be formed to have a length corresponding to a distance between the source electrode S2 and the drain electrode D2 in order to short the source electrode S2 and the drain electrode D2.

Herein, the first welding pattern 410 and the second welding pattern 420 may be, for example, a transparent electrode formed of Indium Tin Oxide (ITO), Indium Zinc Oxide (IZO), Indium Tin Zinc Oxide (ITZO), etc., or may be formed of, for example, a metal or a metal oxide.

When a transistor structure illustrated in FIG. 5, part (B) corresponds to a structure in which driving transistors of the OLED are configured by two driving transistors, an anode electrode of an organic light emitting diode may be connected to the source electrode S2 of the second transistor T2. Herein, the anode electrode may be a transparent electrode formed of Indium Tin Oxide (ITO), Indium Zinc Oxide (IZO), Indium Tin Zinc Oxide (ITZO), etc., or may be formed of a metal or a metal oxide, which is like the first welding pattern 410 and the second welding pattern 420, so that the anode electrode may be formed together with a process of forming the first welding pattern 410 and the second welding pattern 420.

Referring to FIG. 6, part (B), illustrated is an exemplary sectional view of the pixel having the repair transistor structure as shown in FIG. 6, part (A). A connection pattern for connecting the drain electrode D1 and the source electrode S1 of the first transistor T1 is formed through a laser welding process which irradiates a laser beam to the first welding pattern 410 for shorting the first transistor T1 having a problem that foreign substances are generated during processes.

Accordingly, the drain electrode D1 of the first transistor T1, a drain electrode connection portion 411, the first welding pattern 410, a source electrode connection portion 412, and the source electrode S1 are connected to each other like one signal line, so that the drain electrode D1 and the source electrode S1 of the first transistor T1 are shorted, and the first transistor T1 cannot operate as a switching element.

Here, the drain electrode connection portion 411 and the source electrode connection portion 412 correspond to welding particles newly generated through the laser welding process. Further, the connection pattern corresponds to such welding particles (the drain electrode connection portion 411 and the source electrode connection portion 412), or a pattern including the welding particles (the drain electrode connection portion 411 and the source electrode connection portion 412) and the first welding pattern 410. In the pixel before the repair process is performed as described above, that is, in the pixel without any connection patterns, the first transistor T1 and the second transistor T2 are connected to each other in series so as to perform a switching operation together.

Meanwhile, in the repair-processed pixel, that is, in at least one pixel in which a connection pattern is formed by welding one of the first welding pattern 410 and the second welding pattern 420, only one of the first transistor T1 and the second transistor T2 without the connection pattern performs a switching operation.

Meanwhile, the display device 100 having the repair transistor structure according to an embodiment may correspond to an OLED or an LCD.

When the display device 100 having the repair transistor structure according to an embodiment corresponds to an OLED, the first transistor T1 and the second transistor T2 disposed at each of a plurality of pixels correspond to a redundancy transistor set for performing the repair process with respect to one of a driving transistor for driving the organic light emitting diode, a switching transistor for transferring a voltage to a gate node of the driving transistor, a sensing transistor for transferring a voltage to a source node or a drain node of the driving transistor at the corresponding pixel, etc.

When the display device 100 having the repair transistor structure according to an embodiment corresponds to an LCD, gate nodes of the first transistor T1 and the second transistor T2 may be simultaneously connected to a gate line, a source node of one (e.g., the first transistor T1) of the first transistor T1 and the second transistor T2 may be connected to a data line, and a drain node of the other one may be connected to a pixel electrode.

In the above, the repair transistor structure according to an embodiment in which the first transistor T1 and the second transistor T2 are disposed in one pixel in the series structure, and the repair process using the repair transistor structure have been described.

Hereinafter, the repair transistor structure according to another embodiment in which the first transistor T1 and the second transistor T2 are disposed in one pixel in the parallel structure, and the repair process using the repair transistor structure will be described with reference to FIG. 7.

Figure 7:
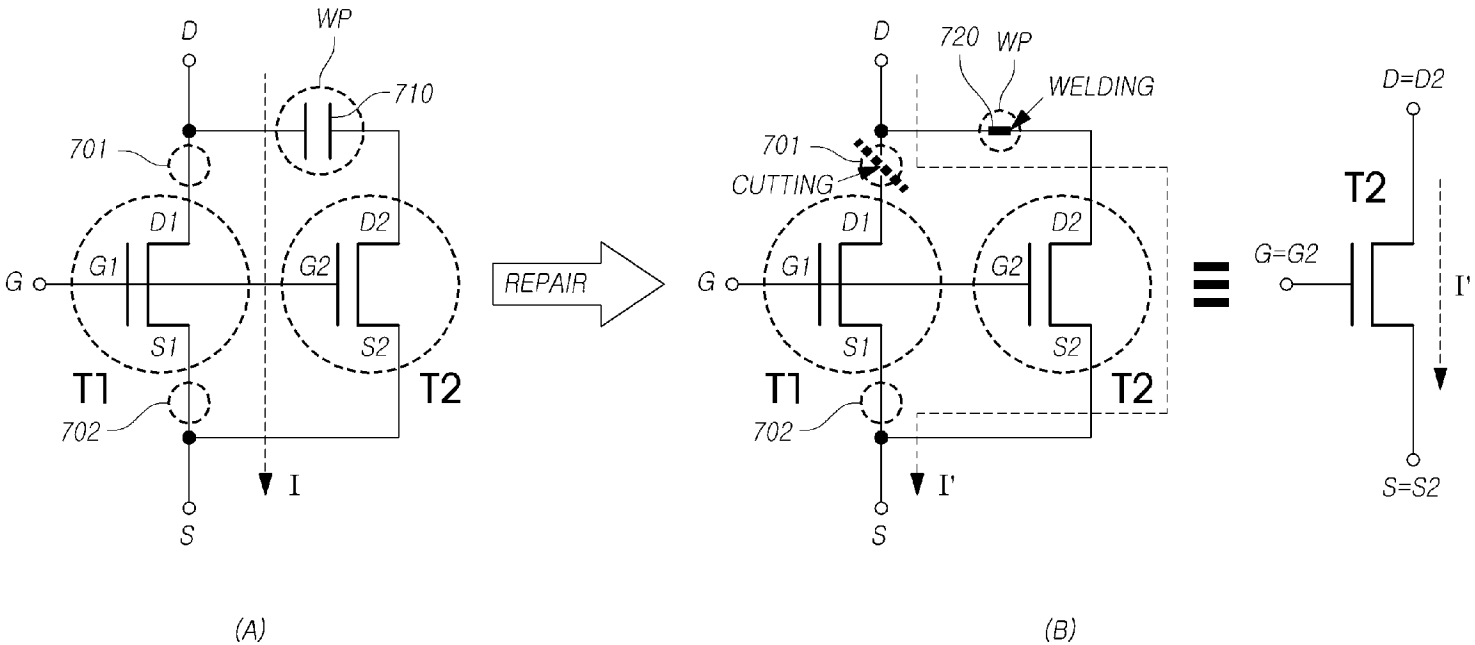
FIG. 7 illustrates a pixel having a repair transistor structure according to another embodiment, before a repair process in part (A) and after a repair process in part (B)

FIG. 7, parts (A) and (B) illustrate a pixel having a repair transistor structure according to another embodiment, before and after a repair process.

FIG. 7, part (A) illustrates a case where the pixel having the repair transistor structure according to another embodiment is in a normal state, and FIG. 7, part (B) illustrates a result obtained by performing the repair process on the corresponding pixel that is identified as a defective pixel.

Referring to FIG. 7, parts (A) and (B), in a pixel having the repair transistor structure according to another embodiment, the first transistor T1 and the second transistor T2 are disposed in the parallel structure. Referring to FIG. 7, part (A), the first transistor T1 and the second transistor T2 are connected to each other in parallel between a supply port D and an output port S, and a welding pattern 710 may be formed to disable the second transistor T2 from conducting current between the supply port D and the output port S.

Although it is illustrated in FIG. 7, part (A) that a capacitor is implemented as the welding pattern 710, not only the capacitor but also any component, which is formed at a WP and disables current to flow through the second transistor T2 can be used as the welding pattern 710.

Meanwhile, referring to FIG. 7, part (A), when the first transistor T1 and the second transistor T2 are disposed in parallel, the first transistor T1 and the second transistor T2 may be disposed between the supply port D and the output port S in parallel, and a disconnected point instead of the welding pattern 710 may be formed between the second transistor T2 and at least one (in FIG. 7, the supply port D) of the supply port D and the output port S. In this case, at a time of the repair process, the disconnected point can be connected by welding. However, for the convenience of the description, hereinafter, the present invention will be described based on an assumption that the welding pattern 710 is connected between the second transistor T2 and at least one (in FIG. 7, the supply port D) of the supply port D and the output port S.

Referring to FIG. 7, part (A), in the pixel before the repair process is performed according to another embodiment, a current I is conducted from the supply port D to the output port S only through the first transistor T1 due to the welding pattern 710 or the disconnected point.

When a problem occurs in the first transistor T1 in the pixel having the repair transistor structure according to another embodiment, in order to perform the repair process for the corresponding pixel, at least one of a point 701, between the first transistor T1 and the supply port D, and a point 702, between the first transistor T1 and the output port S, is cut, and the welding pattern 710 or the disconnected point is welded through the laser welding process. Accordingly, a connection pattern is formed at a point where the welding pattern 710 or the disconnected point is welded.

The WP where the welding pattern 710 or the disconnected point is formed may be located between the drain node D2 of the second transistor T2 and the supply port D or between the source node S2 of the second transistor T2 and the output port S. Further, the WP may be located between the drain node D2 of the second transistor T2 and the supply port D and between the source node S2 of the second transistor T2 and the output port S.

Referring to FIG. 7, part (B), as described above, there may be at least one repair-processed pixel among the plurality of pixels of the display panel 110. In the at least one pixel, a point between the first transistor T1 and at least one of the supply port D and the output port S is cut, and a connection pattern which makes the second transistor T2 conduct a current between the supply port D and the output port S may be formed. Here, the connection pattern is formed by welding the welding pattern 710.

In this way, in the pixel where the connection pattern is formed, a current I' is conducted from the supply port D to the output port S only through the second transistor T2.

Thus, as illustrated in FIG. 7, part (B), the repair-processed pixel may be represented as the second transistor.

In the repair transistor structure according to another embodiment, the second transistor T2 corresponds to a redundancy transistor of the first transistor T1. Accordingly, the size of the second transistor T2 may be designed to be smaller than that of the first transistor in consideration of an aperture ratio, a size, etc. of the display panel 110. Here, the size of the transistor relates to a current driving capacity, and may be determined by a channel width W, a channel length L, etc.

Meanwhile, in the repair transistor structure according to another embodiment, the current I' flowing through the second transistor after the repair process may decrease as compared with the current I flowing through the first transistor T1 before the repair process. In this case, a decrease in luminance may occur at the corresponding pixel.

To this end, after the repair process, the data driving unit 120 can supply a data voltage compensated according to a size difference between the first transistor T1 and the second transistor T2, to the pixel in which the connection pattern is formed.

In this regard, when the number of the pixels that are repaired according to an embodiment is not large, influence on a difference in the current from expected and the difference in the luminance from expected according to the difference in the current may be insignificant. However, when the number of the pixels that are repaired increases or the difference in the luminance becomes significant, the difference in the luminance should be compensated for. After the repair process is performed on the pixel having the repair transistor structure according to an embodiment, the difference in the luminance may be compensated for. This operation will be described in more detail with reference to FIGS. 16 to 23 below.

The display device 100 having the repair transistor structure according to another embodiment may correspond to an OLED or an LCD.

When the display device 100 having the repair transistor structure according to another embodiment corresponds to an OLED, the first transistor T1 and the second transistor T2 disposed at each of a plurality of pixels correspond to a redundancy transistor set for performing the repair process with respect to one of a driving transistor for driving the organic light emitting diode, a switching transistor for transferring a voltage to a gate node of the driving transistor, a sensing transistor for transferring a voltage to a source node or a drain node of the driving transistor, at the corresponding pixel, etc.

When the display device 100 having the repair transistor structure according to another embodiment corresponds to an LCD, gate nodes of the first transistor T1 and the second transistor T2 may be simultaneously connected to a gate line, source nodes of the first transistor T1 and the second transistor T2 may be connected with a data line, and a drain node of the second transistor T2 may be connected to a pixel electrode connected to a drain node of the first transistor T1, through the welding pattern 710.

In the above, the two types of the repair transistor structures corresponding to transistor structures within each pixel, which are configured such that each pixel of the display device 100 which may correspond to the OLED, the LCD, etc. can be repair-processed, have been described.

Hereinafter, an OLED and an LED, in which a repair transistor structure according to another embodiment which is different from the above-described repair transistor structure according to the embodiments is applied to pixels thereof, will be described.

Firstly, a repair process and luminance compensation according to the repair process, applied to a pixel in an OLED having a repair transistor structure according to an embodiment or another embodiment, will be described.

Figure 8:
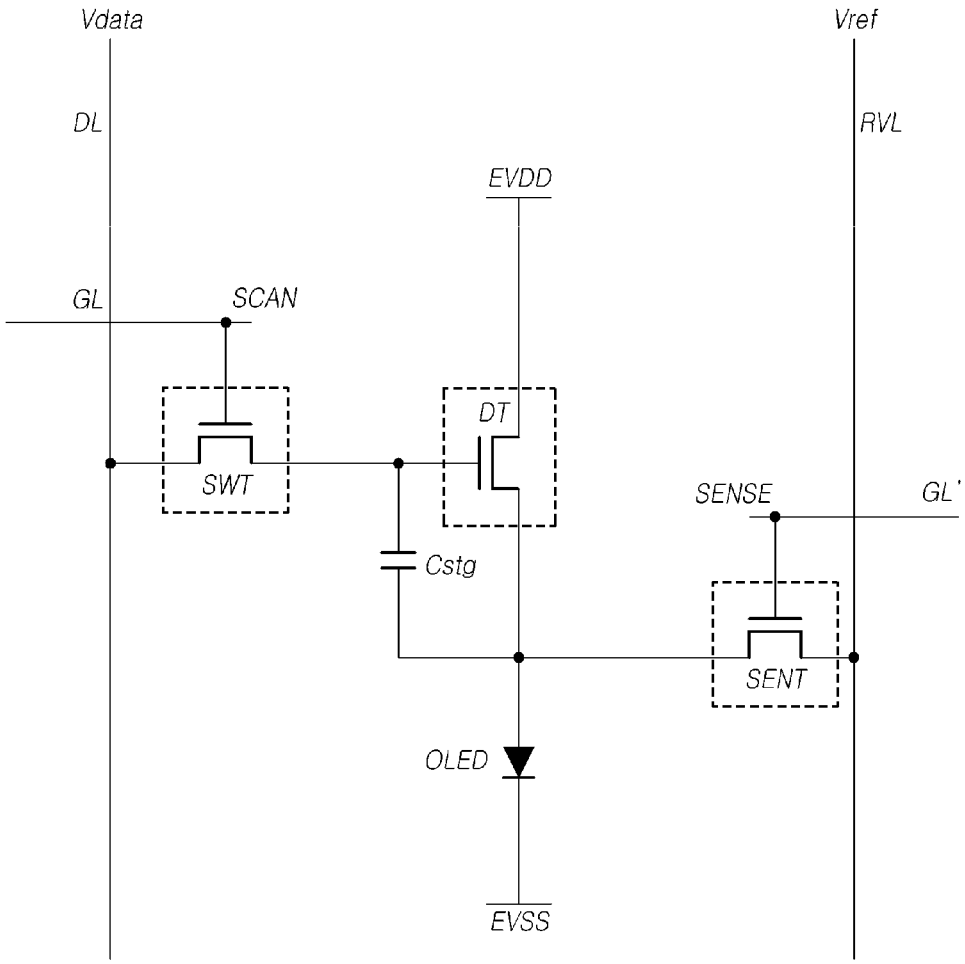
FIG. 8 is an equivalent circuit diagram of a pixel not having a repair transistor structure when a display device is an OLED.

FIG. 8 is an equivalent circuit diagram of a pixel without a repair transistor structure, in an OLED.

For example, each of pixels not having the repair transistor structure includes an organic light emitting diode, a driving transistor DT for receiving a driving voltage EVDD and driving the organic light emitting diode, a switching transistor SWT controlled by a scan signal SCAN supplied through a first gate line GL and connected between a data line DL and a gate node of the driving transistor DT, a sensing transistor SENT controlled by a sensing signal SENSE supplied through a second gate line GL' and connected between a reference voltage line RVL to which a reference voltage Vref is supplied and a source node of the driving transistor DT, a storage capacitor Cstg connected between the gate node and the source node of the driving transistor DT, etc.

The above-described repair transistor structure according to an embodiment or another embodiment may be applied to at least one of the three transistors DT, SWT and SENT within the pixel of the OLED illustrated in FIG. 8.

That is, when the display device 100 corresponds to an OLED, the first transistor T1 may be one of the transistors (e.g., DT, SWT, SENT, etc.) within a driving circuit for driving the organic light emitting diode at each pixel. Thus, the second transistor T2 corresponds to a transistor which performs the same function as that of the first transistor T1 after the repair process.

Figure 9:
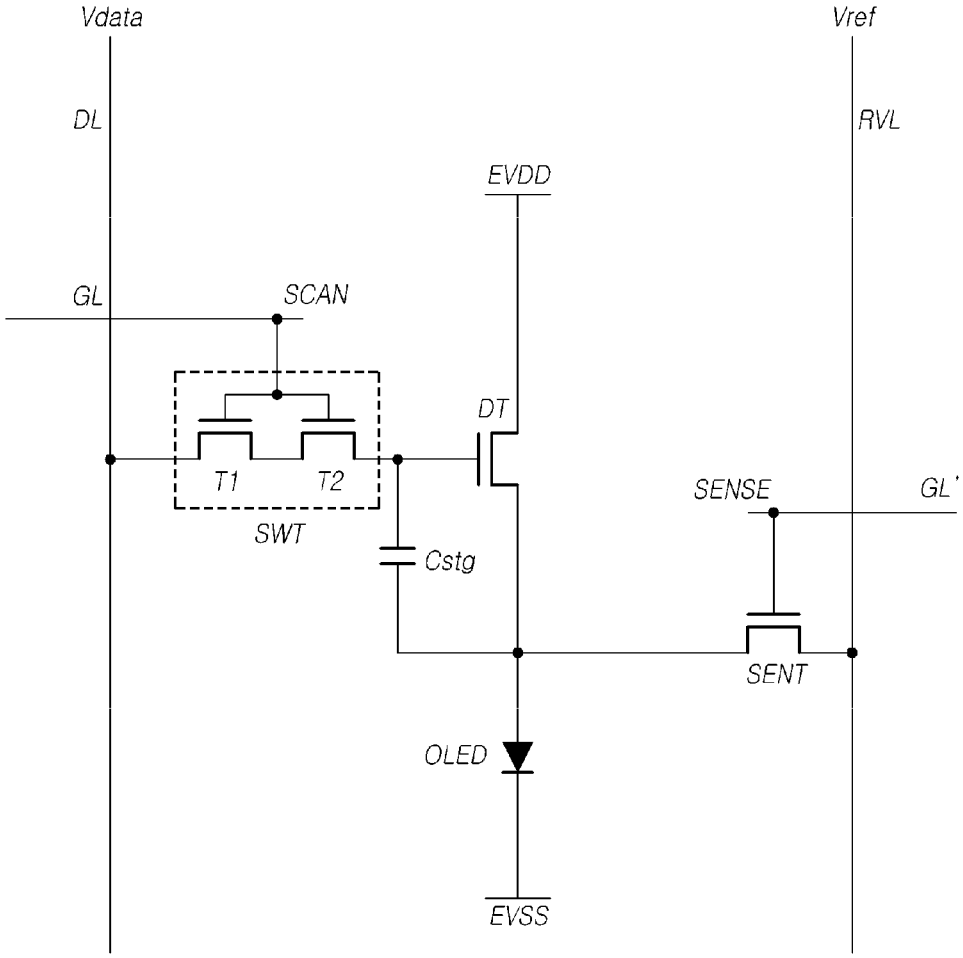
FIGS. 9 to 11 are three equivalent circuit diagrams of a pixel having a repair transistor structure according to an embodiment when a display device is an OLED.

FIG. 9 is an equivalent circuit diagram illustrating a case where the switching transistor SWT among the three transistors DT, SWT and SENT within the pixel of the OLED is configured to have the repair transistor structure according to an embodiment.

Referring to FIG. 9, before the repair process, the first transistor T1 and the second transistor T2 are turned on by simultaneously receiving the scan signal SCAN through gate nodes thereof. Further, the first transistor T1 receives a data voltage to supply the data voltage to a gate node of the driving transistor DT through the second transistor T2. That is, both of the first transistor T1 and the second transistor T2 act as one switching transistor SWT by performing a switching operation.

In case a problem occurs in the first transistor T1, a repair process is performed on the first transistor T1 by shorting the first transistor T1 (i.e., shorting a drain node and a source node of the first transistor T1) as a single conductor. After the repair process, only the second transistor T2 acts as one switching transistor SWT by operating as a switching element.

The equivalent circuit after the repair process is equal to a circuit obtained by replacing the switching transistor SWT with the second transistor T2 from the circuit of FIG. 8.

Figure 10:
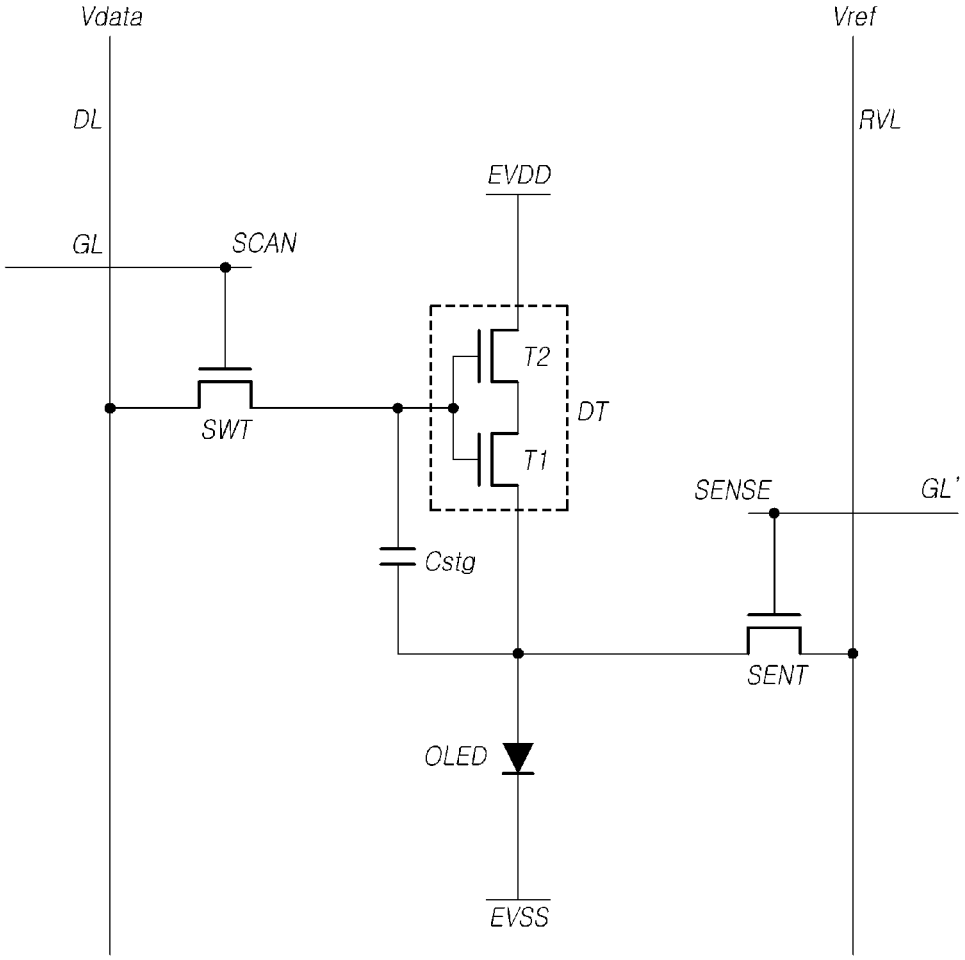

FIG. 10 is an equivalent circuit diagram illustrating a case where the driving transistor DT among the three transistors DT, SWT and SENT within the pixel of the OLED is configured to have the repair transistor structure according to an embodiment.

Referring to FIG. 10, before the repair process, the first transistor T1 and the second transistor T2 simultaneously receive a data voltage from the switching transistor SWT through a gate node.

Referring to FIG. 10, a predetermined voltage is applied to the source node S1 of the first transistor T1, and a driving voltage EVDD is applied to a drain node of the second transistor T2.

Thus, referring to FIG. 10, the first transistor T1 and the second transistor T2 operate together so as to act as one driving transistor DT.

In an example illustrated in FIG. 10, the first transistor T1 has a defect, and the repair process is performed on the first transistor T1, thereby shorting the first transistor T1.

After such a repair process, only the second transistor T2 separately acts as one driving transistor DT.

The equivalent circuit after the repair process can be represented as a circuit with the driving transistor DT replaced with the second transistor T2 from the circuit of FIG. 8.

Figure 11:
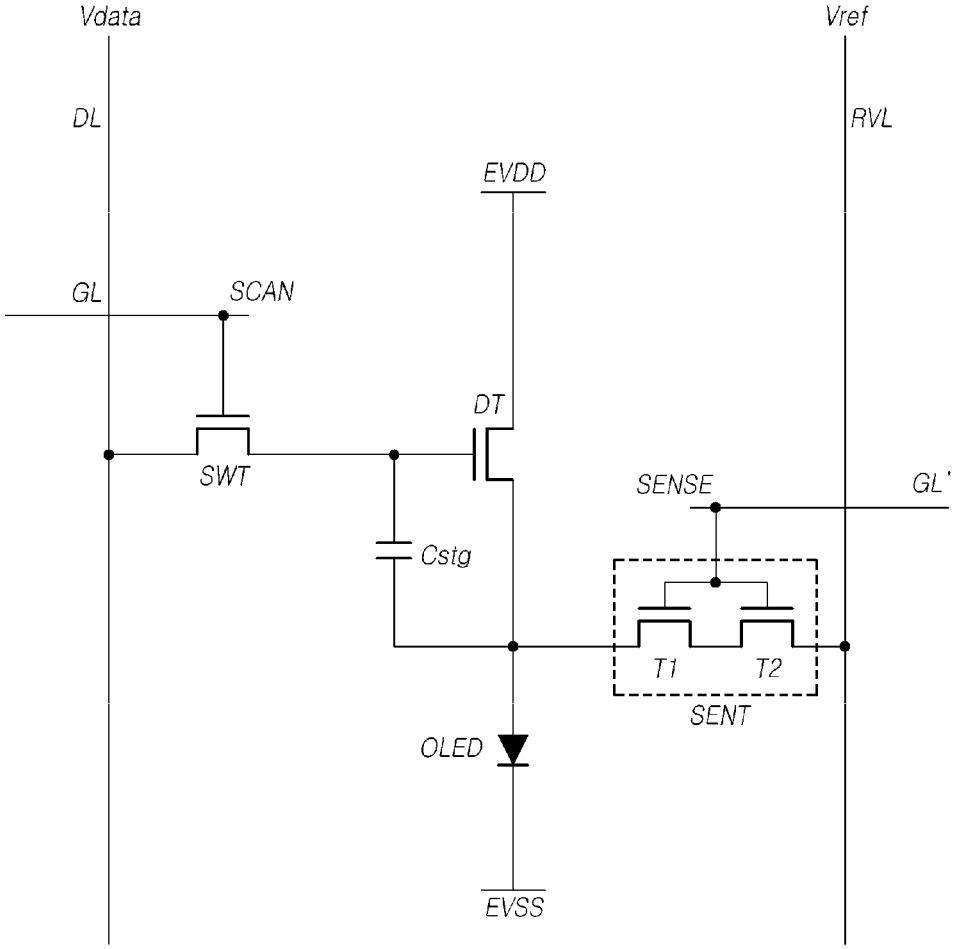

FIG. 11 is an equivalent circuit diagram illustrating a case where the sensing transistor SENT among the three transistors DT, SWT and SENT within the pixel of the OLED is configured to have the repair transistor structure according to an embodiment.

Referring to FIG. 11, before the repair process, the first transistor T1 and the second transistor T2 simultaneously receive a sensing signal SENSE.

Further, the second transistor T2 (or the first transistor T1) can receive a reference voltage from the reference voltage line RVL, and apply the reference voltage to the source node of the driving transistor DT through the first transistor T1.

Thus, the first transistor T1 and the second transistor T2 operate together so as to act as one sensing transistor SENT.

In an example illustrated in FIG. 11, the first transistor T1 has a defect, and the repair process is performed on the first transistor T1, thereby shorting the first transistor T1.

After the repair process, only the second transistor T2 acts as one sensing transistor SENT by operating as a switching element.

The equivalent circuit after the repair process can be represented as a circuit with the sensing transistor SENT replaced with the second transistor T2 from the circuit of FIG. 8.

In FIGS. 9 to 11, the repair transistor structure according to an embodiment is applied to one of the driving transistor DT, the switching transistor SWT and the sensing transistor SENT. However, the repair transistor structure according to an embodiment can be applied to two or more of the driving transistor DT, the switching transistor SWT and the sensing transistor SENT.

Hereinafter, a case, where the repair transistor structure according to another embodiment is applied to at least one of the three transistors DT, SWT and SENT within the pixel of the OLED illustrated in FIG. 8, will be described with reference to FIGS. 12 to 14.

Figure 12:
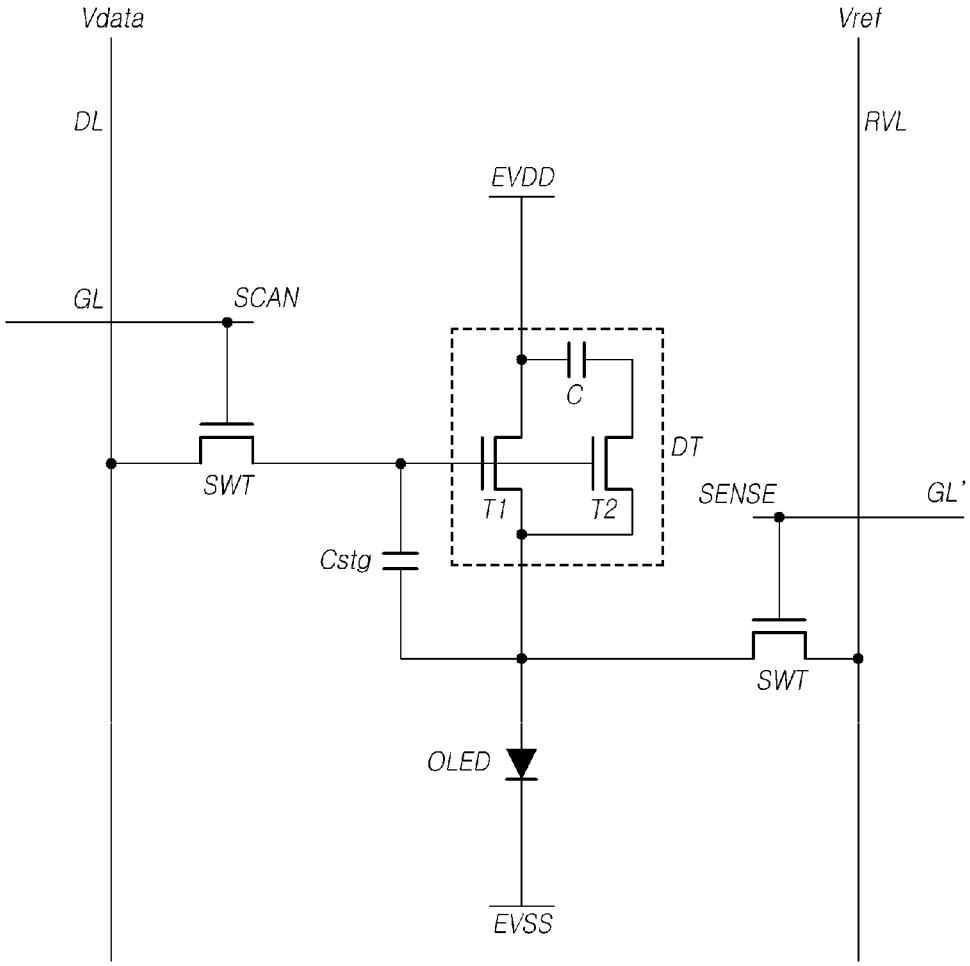
FIGS. 12 to 14 are three equivalent circuit diagrams of a pixel having a repair transistor structure according to another embodiment when a display device is an OLED.

FIG. 12 is an equivalent circuit diagram illustrating a case where the driving transistor DT among the three transistors DT, SWT and SENT within the pixel of the OLED is configured to have the repair transistor structure according to another embodiment.

Referring to FIG. 12, before the repair process, the first transistor T1 and the second transistor T2 simultaneously receive a data voltage Vdata from the switching transistor SWT through a gate node.

However, because of a capacitor C, the second transistor T2 cannot conduct current to flow through the organic light emitting diode by receiving a driving voltage EVDD, and only the first transistor T1 can conduct current to flow through the organic light emitting diode by receiving the driving voltage EVDD.

Thus, before the repair process, only the first transistor T1 acts as one driving transistor DT.

The equivalent circuit before the repair process can be represented as a circuit with the driving transistor DT replaced with the first transistor T2, from the circuit of FIG. 8.

Referring to FIG. 12, when the first transistor T1 has a defect, the first transistor T1 is cut, and the capacitor C formed in a welding point WP is welded through a laser welding process.

After such a repair process, only the second transistor T1 receives the driving voltage EVDD to conduct current to flow through the organic light emitting diode.

In this case, only the second transistor T2 acts as one driving transistor DT.

The equivalent circuit in this case can be represented as a circuit with the driving transistor DT replaced with the second transistor T2, from the circuit of FIG. 8.

Figure 13:
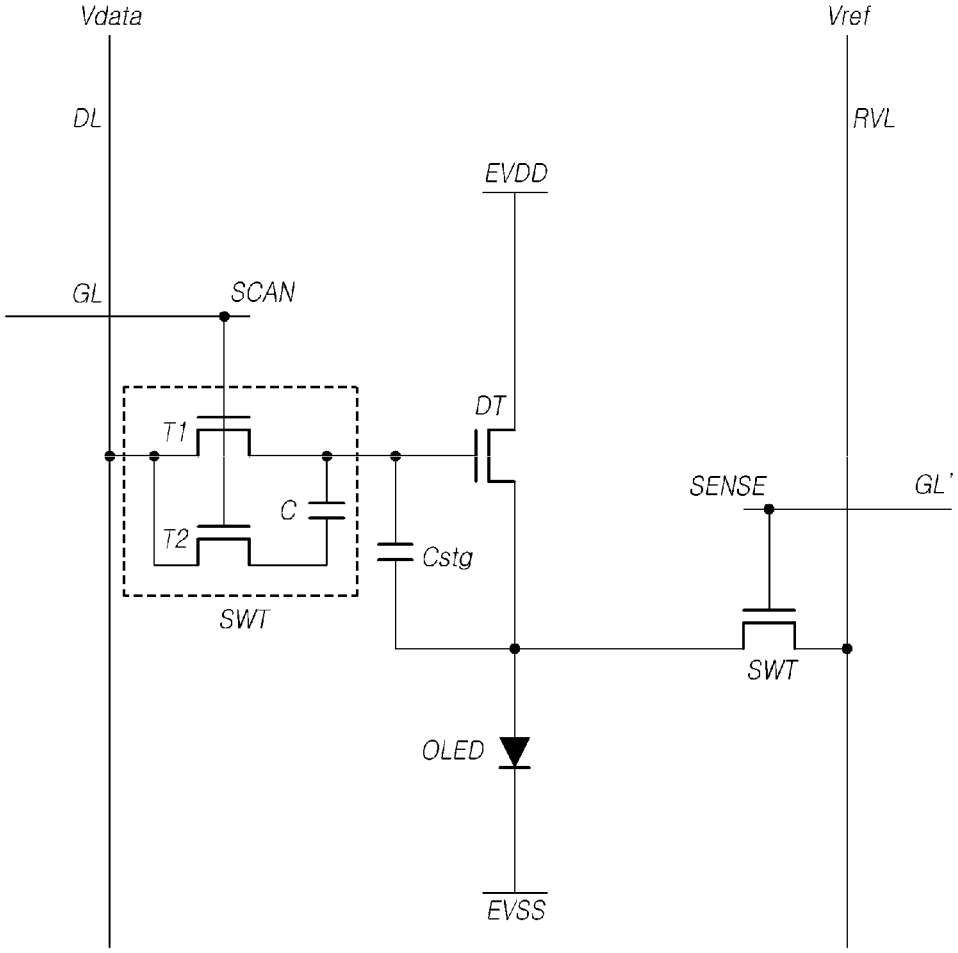

FIG. 13 is an equivalent circuit diagram illustrating a case where the switching transistor SWT among the three transistors DT, SWT and SENT within the pixel of the OLED is configured to have the repair transistor structure according to another embodiment.

Referring to FIG. 13, before the repair process, the first transistor T1 and the second transistor T2 simultaneously receive a scan signal SCAN through gate nodes thereof.

However, because of a capacitor C, the second transistor T2 cannot apply a data voltage supplied through a data line DL to a gate node of a driving transistor DT, but only the first transistor T1 applies the data voltage supplied through the data line DL to the gate node of the driving transistor DT.

Thus, before the repair process, only the first transistor T1 acts as one switching transistor SWT.

The equivalent circuit before the repair process is equal to a circuit obtained by replacing the switching transistor SWT with the first transistor T2, from the circuit of FIG. 8.

Referring to FIG. 13, when a problem occurs in the first transistor T1, a repair process is performed in which the first transistor T1 is cut and the capacitor C is welded.

After such a repair process, only the second transistor T2 acts as one switching transistor SWT which applies the data voltage supplied through the data line DL to a gate node thereof.

The equivalent circuit after the repair process can be represented as a circuit with the switching transistor SWT replaced with the second transistor T2 from the circuit of FIG. 8.

Figure 14:
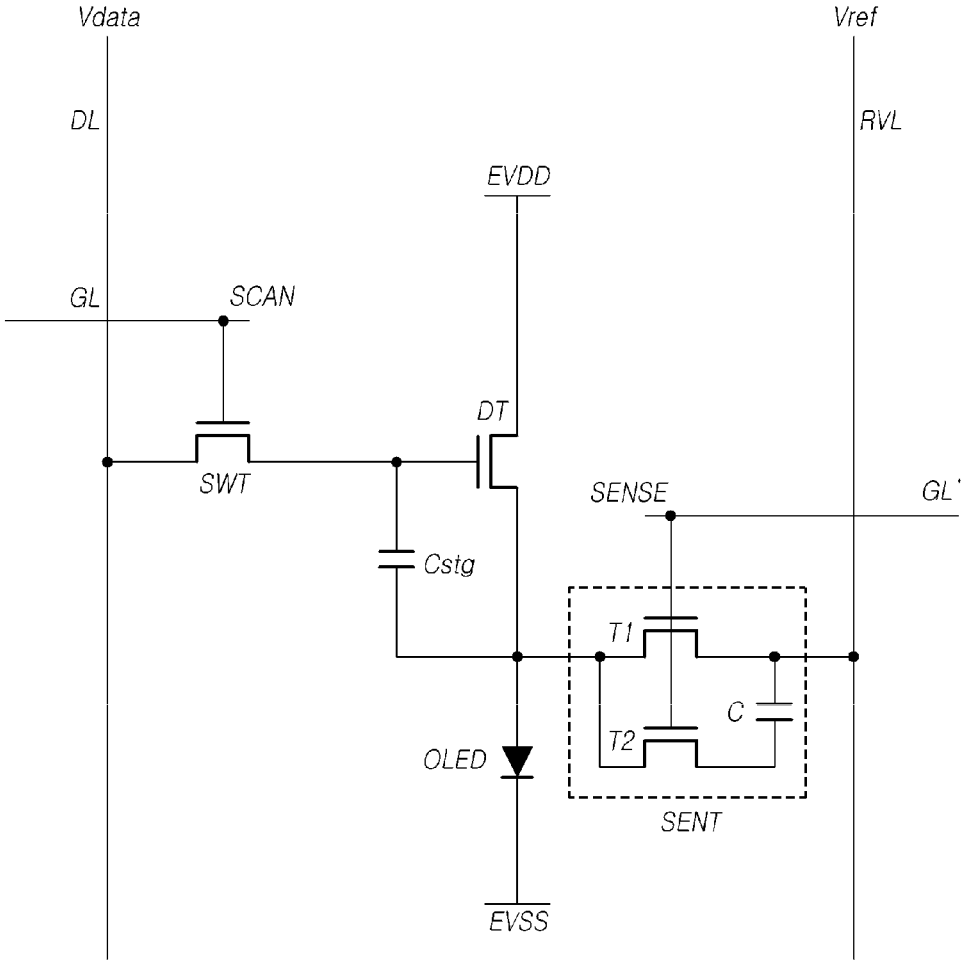

FIG. 14 is an equivalent circuit diagram illustrating a case where the sensing transistor SENT among the three transistors DT, SWT and SENT within the pixel of the OLED is configured to have the repair transistor structure according to another embodiment.

Referring to FIG. 14, before the repair process, the first transistor T1 and the second transistor T2 simultaneously receive a sensing signal SENSE.

However, because of a capacitor C, the second transistor T2 cannot apply a reference voltage supplied from a reference voltage line RVL to a source node of a driving transistor DT, and only the first transistor T1 can apply the reference voltage supplied from the reference voltage line RVL to the source node of the driving transistor DT.

Thus, before the repair process, only the first transistor T1 acts as one sensing transistor SENT.

The equivalent circuit before the repair process can be represented as a circuit with the sensing transistor SENT replaced with the first transistor T2 from the circuit of FIG. 8.

Referring to FIG. 14, when a problem occurs in the first transistor T1, a repair process is performed in which the first transistor T1 is cut and the capacitor C is welded.

After such a repair process, only the second transistor T2 acts as one sensing transistor SENT which applies the reference voltage supplied from the reference voltage line DL, to the source node of the driving transistor DT.

The equivalent circuit after the repair process is equal to a circuit obtained by replacing the sensing transistor SENT with the second transistor T2 from the circuit of FIG. 8.

In the pixel of FIGS. 9 to 11 in which the repair transistor structure according to an embodiment is applied to each of the transistors DT, SWT and SENT within the corresponding pixel, and the pixel of FIGS. 12 to 14 in which the repair transistor structure according to another embodiment is applied to each of the transistors DT, SWT and SENT within the corresponding pixel, after the corresponding repair process is performed, only the second transistor T2 between the first transistor T1 and the second transistor T2 operates normally. Thus, a pixel structure after the repair process may be illustrated as in FIG. 15.

Figure 15:
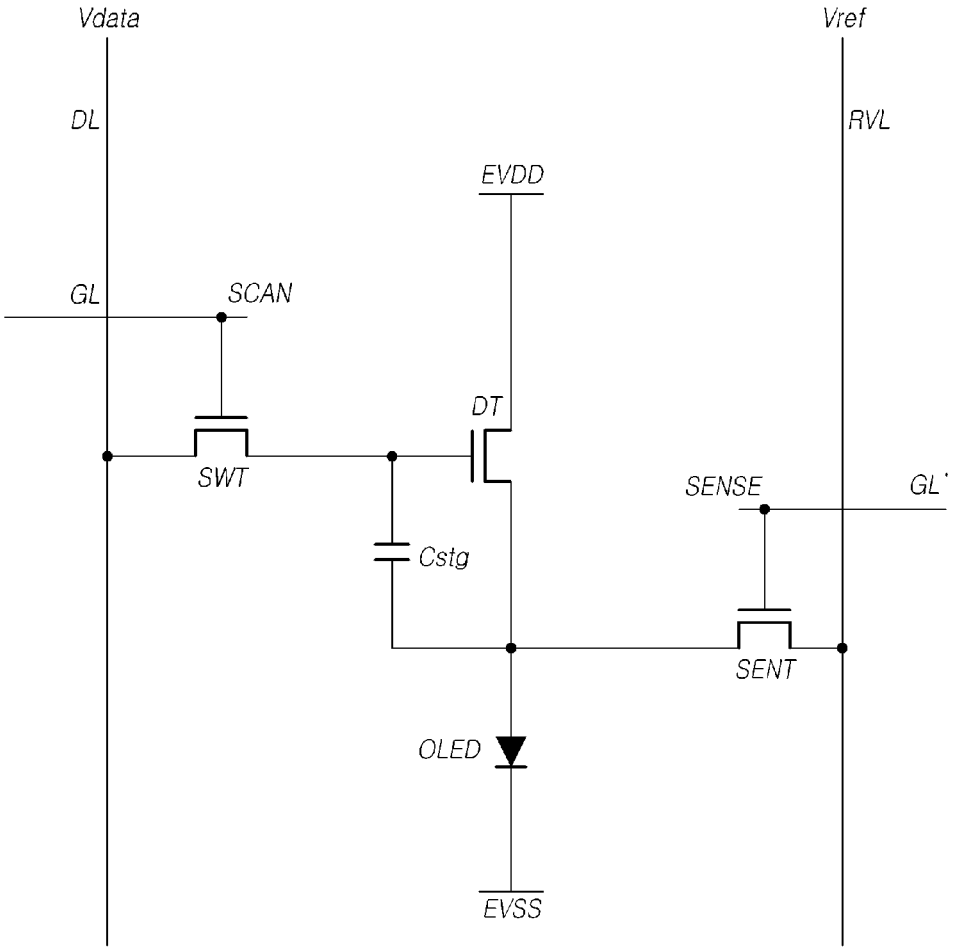
FIG. 15 is an equivalent circuit diagram of a pixel having a repair transistor structure according to an embodiment or another embodiment after a repair process when a display device is an OLED.

In FIG. 15, at least one of a driving transistor DT, a switching transistor SWT and a sensing transistor SENT includes the second transistor T2 operating normally.

Figure 16:
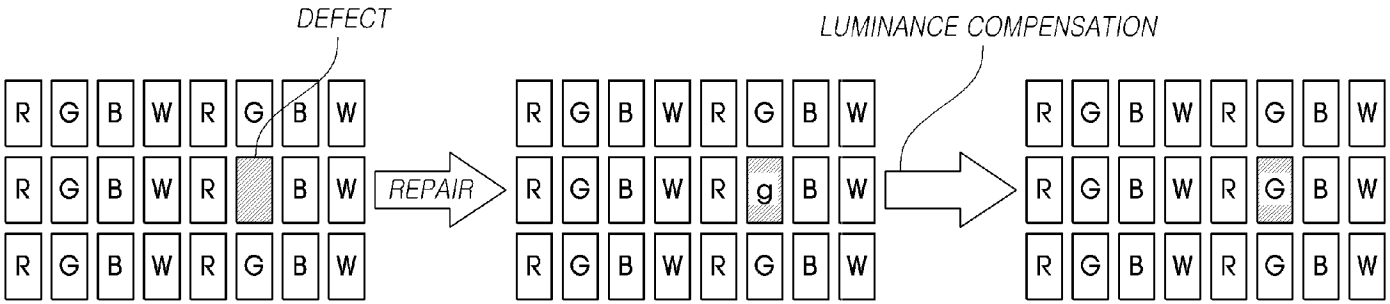
FIG. 16 illustrates a repair process of a pixel having a repair transistor structure according to an embodiment or another embodiment, and a luminance compensation process of the repair-processed pixel when a display device is an OLED.

FIG. 16 illustrates a repair process of a pixel having a repair transistor structure according to an embodiment or another embodiment, and a luminance compensation process of the repair-processed pixel when a display device is an OLED.

Referring to FIG. 16, in a RGBW pixel structure to which the repair transistor structure according to an embodiment or another embodiment is applied, when a green pixel becomes a defective pixel and the green pixel corresponding to the defective pixel is repaired to a normal pixel according to the repair process in accordance with the corresponding repair transistor structure, because a current supplied to the organic light emitting diode is decreased after the repair process, the repaired green pixel does not emit a green light corresponding to a predetermined color but emits a green light of which the luminance is decreased.

Accordingly, the display device 100 including the display panel 110, in which the pixels having the repair transistor structure according to an embodiment or another embodiment are defined, may further include a compensation circuit unit for compensating for the decrease in the luminance of the pixel repair-processed such that only one of the transistor T1 and the second transistor T2 operates, among the plurality of pixels.

Figure 17:
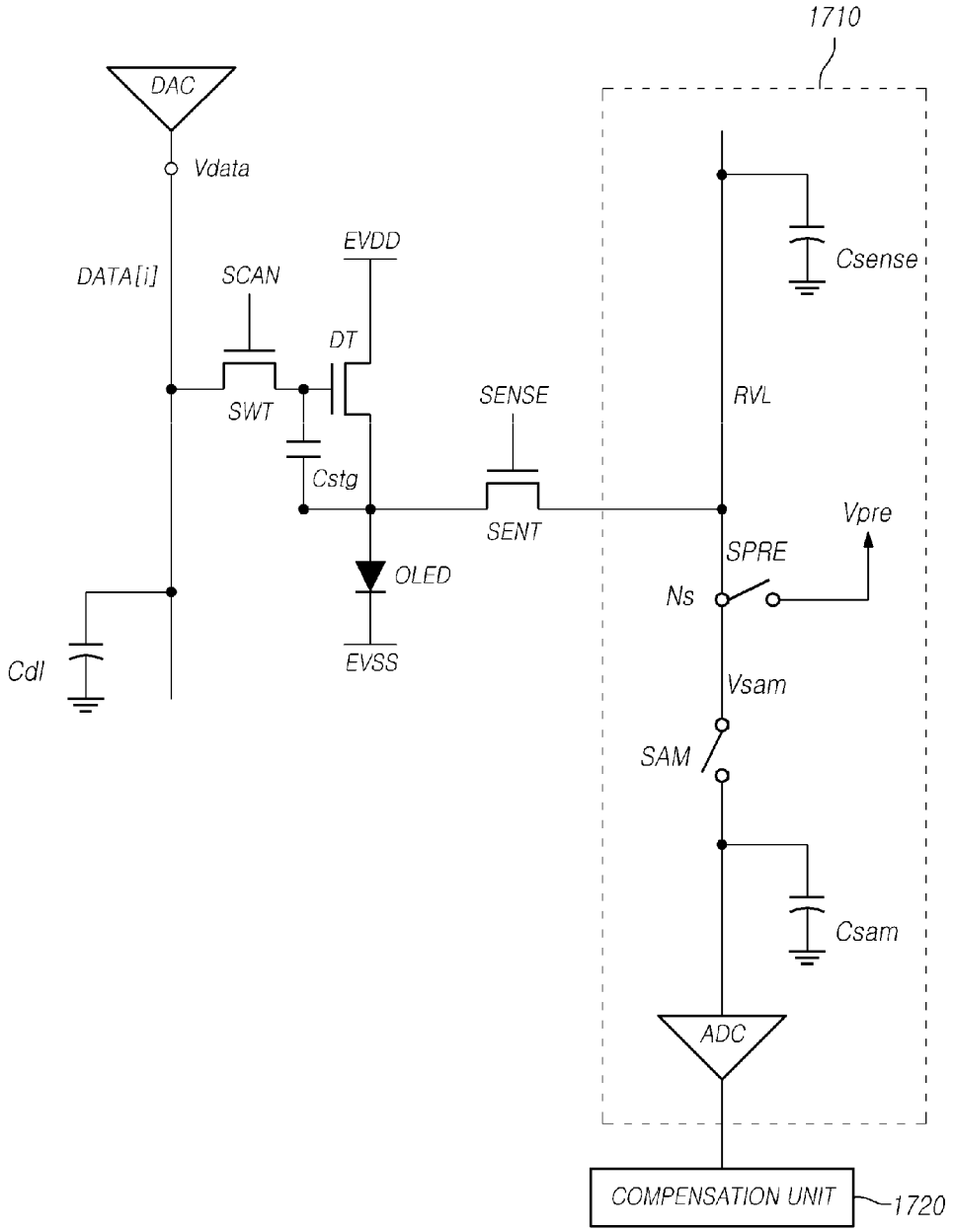
FIG. 17 is a circuit diagram for luminance compensation of a repair-processed pixel having a repair transistor structure according to an embodiment or another embodiment when a display device is an OLED.

FIG. 17 is a circuit diagram for luminance compensation of a repair-processed pixel having a repair transistor structure according to an embodiment or another embodiment, in an OLED.

Referring to FIG. 17, a circuit for the luminance compensation of the repair-processed pixel is obtained by further including the aforementioned compensation circuit unit in the equivalent circuit of FIG. 15 illustrating the repair-processed pixel structure.

Referring to FIG. 17, the compensation circuit unit may include a sensing unit 1710 for sensing the luminance of each of pixels, and a compensation unit 1720 for compensating a luminance difference between the pixels sensed by the sensing unit 1710.

The aforementioned compensation unit 1720 can determine a luminance compensation value indicating which pixel should be compensated and how much the luminance should be compensated for, by calculating the luminance difference between the sensed pixels based on the luminance of each of the sensed pixels.

Thereafter, the compensation unit 1720 can output the determined luminance compensation value to the data driving unit 120, and when the data driving unit 120 supplies a data voltage to the corresponding pixel, can supply a data voltage converted according to the luminance compensation value. Otherwise, the compensation unit 1720 can convert data to be supplied to the data driving unit 120 according to the determined luminance compensation value, and can supply the converted data to the data driving unit 120.

Such a compensation unit 1720 may be included within the timing controller 140, and in some cases, may be included within the data driving unit 120 or outside the data driving unit 120 and the timing controller 140.

Further, the luminance of the pixels sensed by the sensing unit 1710 may be stored in a memory (not illustrated) and updated. A scheme of compensating for the luminance decrease of the repaired pixel, which has been described briefly, will be described in more detail with reference to a timing diagram of FIG. 18 and an operation circuit diagram for each of steps of FIGS. 19 to 22.

Figure 18:
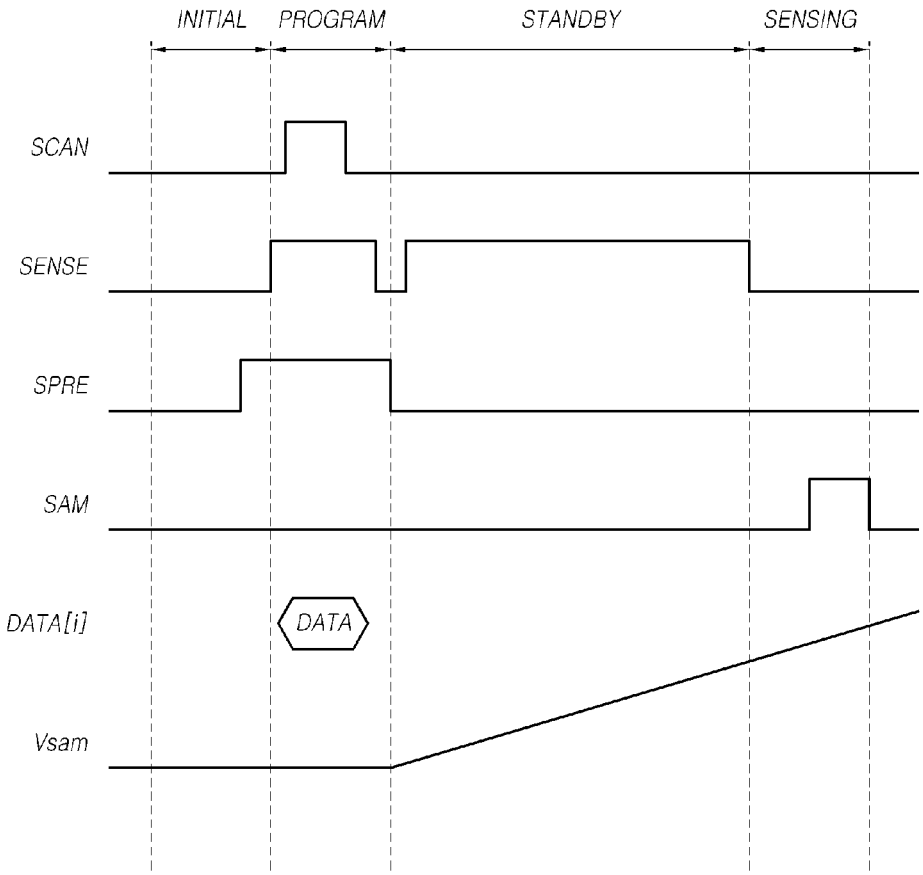
FIG. 18 is a timing diagram for luminance compensation of a repair-processed pixel having a repair transistor structure according to an embodiment or another embodiment when a display device is an OLED.

FIG. 18 is a timing diagram for luminance compensation of a repair-processed pixel having a repair transistor structure according to an embodiment or another embodiment, in an OLED.

Referring to FIG. 18, a sensing mode for compensating the luminance decrease of the repaired pixel in the display panel is formed by an initial step, a program step, a standby step and a sensing step.

Referring to FIG. 18, in order to perform the sensing mode for compensating for the luminance decrease of the repaired pixel, the timing controller 140 can control operations of the switching transistor SWT and the sensing transistor SENT or control a sampling switch SAM, which enables or disables connection between an Analog Digital Convertor (ADC) and a sensing node Ns, and a switch SPRE, which enables or disables connection between a Vpre supply port (reference voltage supply port) and the sensing node Ns. In one approach, the sensing mode may be performed in an order of the initial step, the program step, the standby step and the sensing step.

A switching operation of a switching transistor SWT can be controlled by controlling a signal level of a scan signal SCAN transmitted to the switching transistor SWT. Further, a switching operation of a sensing transistor SENT can be controlled by controlling a signal level of a sensing signal SENSE transmitted to the sensing transistor SENT. Accordingly, a switching operation of the driving transistor DT can be controlled by controlling a voltage difference Vgs between a gate node and a source node of the driving transistor DT.

Hereinafter, an operation for each step of the sensing mode for compensating for the luminance decrease of the repaired pixel will be described with reference to FIGS. 19 to 22.

FIGS. 19 to 22 are operation circuit diagrams for each step of a sensing mode for luminance compensation of a repair-processed pixel having a repair transistor structure according to an embodiment or another embodiment, in an OLED.

Figure 19:
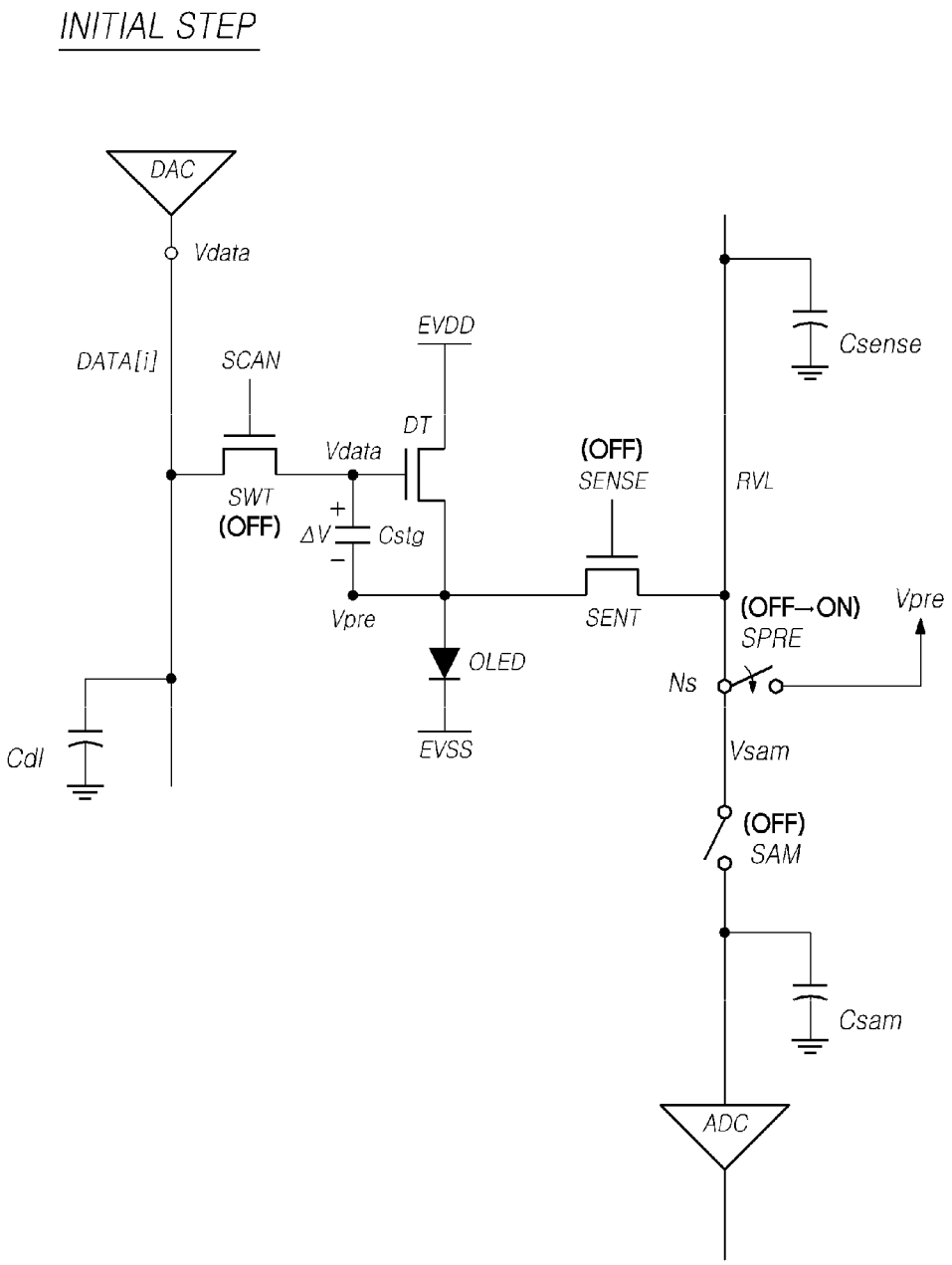
FIGS. 19 to 22 are operation circuit diagrams for each step of a sensing mode for luminance compensation of a repair-processed pixel having a repair transistor structure according to an embodiment or another embodiment when a display device is an OLED.
Figure 20:
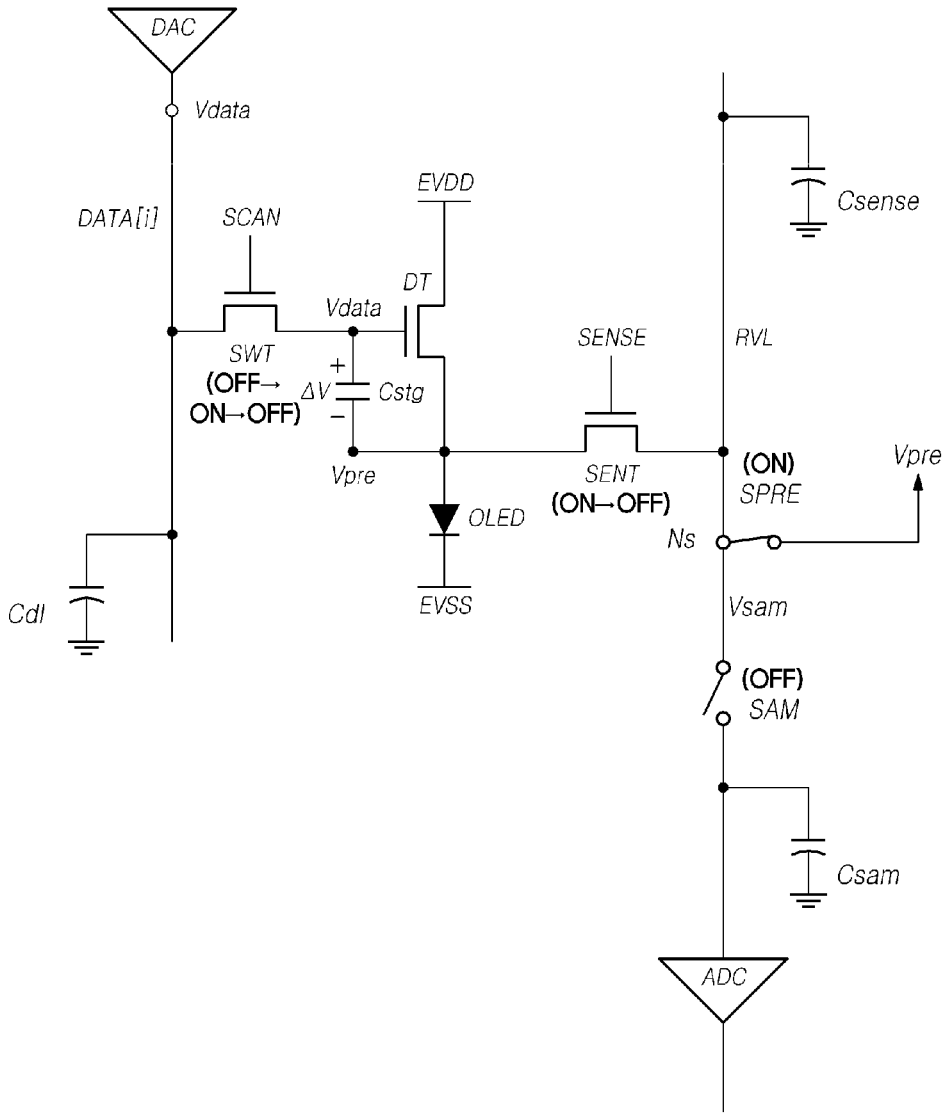
Figure 21:
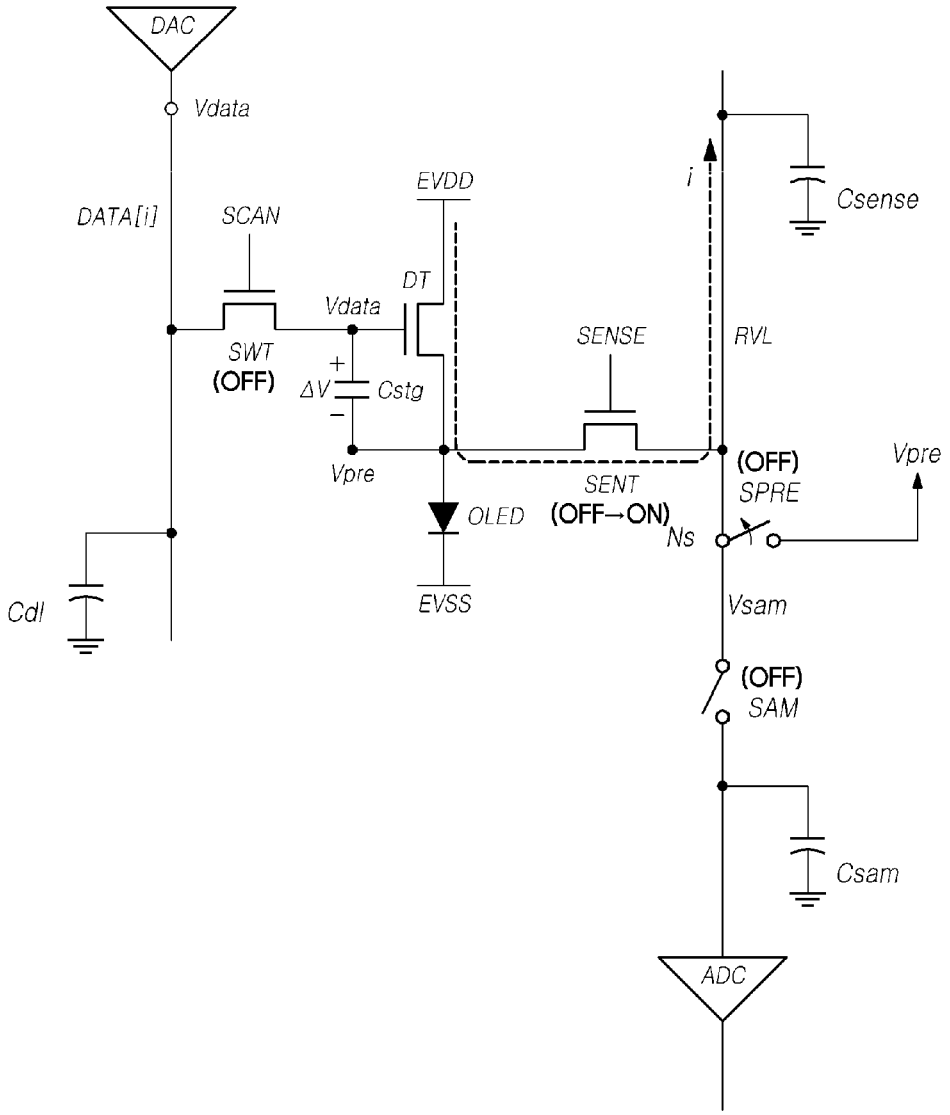
Figure 22:
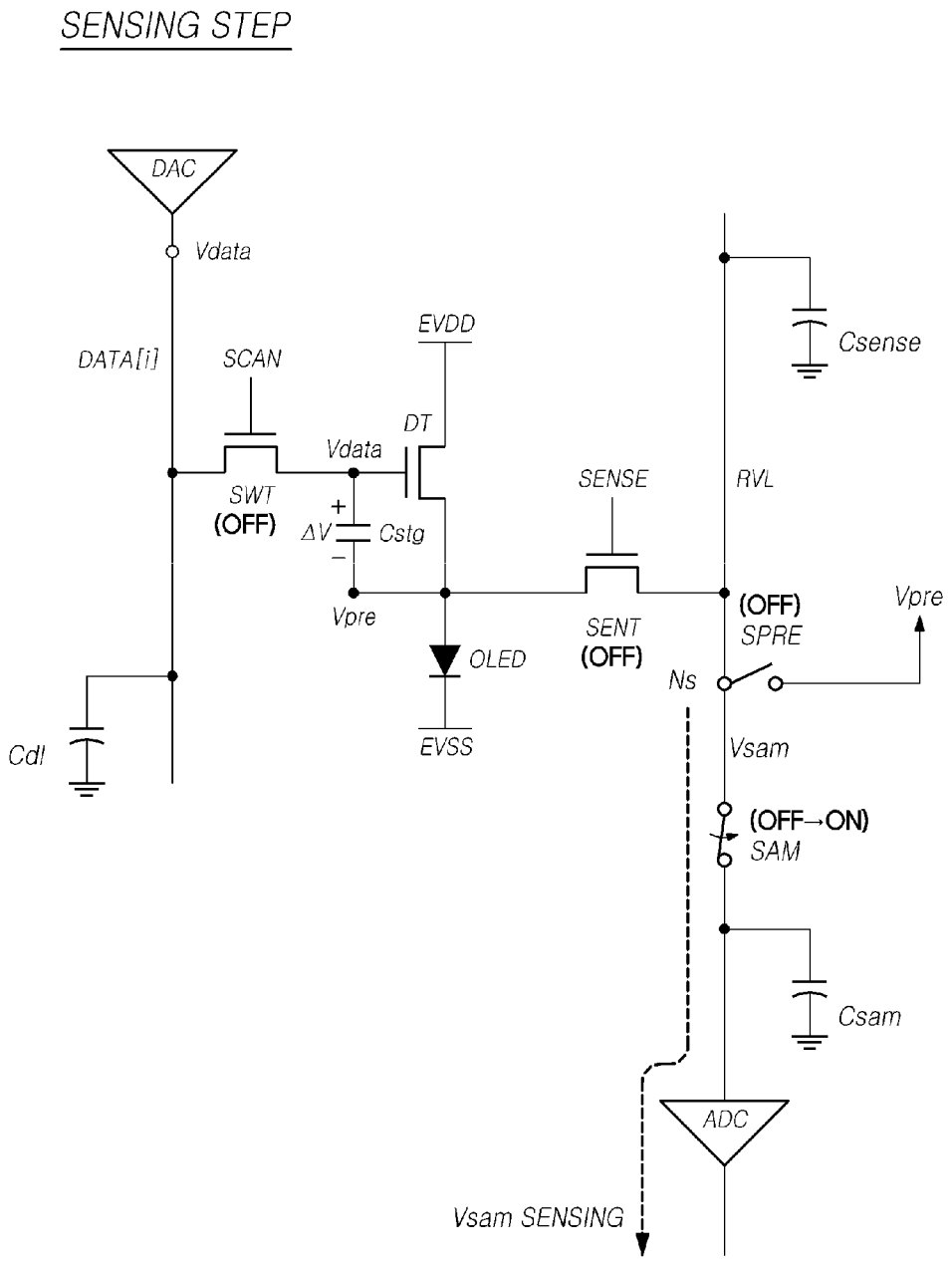

FIG. 19 is an operation circuit diagram of the initial step, FIG. 20 is an operation circuit diagram of the program step, FIG. 21 is an operation circuit diagram of the standby step, and FIG. 22 is an operation circuit diagram of the sensing step.

Referring to FIG. 19 illustrated is the operation circuit diagram of the initial step. The initial step of the sensing operation for compensating for the luminance decrease of the repaired pixel corresponds to a step of initializing a voltage of each node. In this step, a switching transistor SWT is turned off by supplying a scan signal SCAN having a low level, and a sensing transistor SENT is turned off by supplying a sensing signal SENSE having a low level.

In such an initial step, in order to read a sampling voltage Vsam in the ADC, the sampling switch SAM for enabling or disabling connection between the ADC and the sensing node Ns is turned off.

In such an initial step, Vdata is not applied.

Further, in the initial step, the switch SPRE, for enabling or disabling connection between the supply port providing a voltage level Vpre and the sensing node Ns, is initially turned off and is then turned on to preset a voltage level of the sensing node Ns (Vsam) to Vpre.

Referring to FIG. 20 corresponding to the operation circuit diagram of the program step, the program step corresponds to a step of charging a storage capacitor Cstg connected between a gate node and a source node of a driving transistor DT.

In the program step, in order to charge the storage capacitor Cstg, when the data voltage Vdata is applied, the scan signal SCAN having a low level is changed to have a high level so as to turn on the switching transistor SWT, so that a constant-voltage Vdata is applied to the gate node of the driving transistor DT.

At this time, since a signal level of the sensing signal SENSE is changed to a high level and the sensing transistor SENT is then turned on in a state in which the switch SPRE is turned on, a constant voltage Vpre (also, referred to as a reference voltage Vref) is applied to the source node of the driving transistor DT.

Thus, the constant voltages Vdata and Vpre are applied to opposite ends of the storage capacitor Cstg connected between the gate node and the source node of the driving transistor DT, so that the storage capacitor Cstg is charged by an amount of electric charge corresponding to a potential difference ΔV corresponding to a value obtained by subtracting Vpre from Vdata.

While the storage capacitor Cstg is charged, because the constant voltage Vpre or the basis voltage EVSS is regulated such that a potential difference (|Vpre−EVSS|) between the constant voltage Vpre applied to the source node of the driving transistor DT and the basis voltage EVSS is not higher than a threshold voltage of the organic light emitting diode. Therefore, a current does not flow to the organic light emitting diode.

After the storage capacitor Cstg is charged, the scan signal SCAN having a high level is changed to have a low level so that the switching transistor SWT is turned off, and the sensing signal SENSE having a high level is changed to have a low level so that the sensing transistor SENT is turned off. Thereafter, at an end of the program step, the switch SPRE is turned off so that the constant voltage Vpre is not applied to the source node of the driving transistor DT.

Referring to FIG. 21 illustrated is the operation circuit diagram of the standby step. The standby step corresponds to a step of changing a voltage of the sensing node Ns for luminance sensing.

At a starting point of the standby step, a constant potential difference (Vdata−Vpre) is formed between the gate node and the source node of the driving transistor DT, so that the driving transistor Dt is turned on, and all of the switching transistor SWT, the sensing transistor SENT, the switch SPRE and the sampling switch SAM are turned off. Further, at a starting point of the standby step, a current does not flow to the organic light emitting diode.

After the standby step starts, the sensing signal SENSE is changed to have a high level so that the sensing transistor SENT is turned on during the standby step.

Accordingly, current flows from the supply port of the driving voltage EVDD, via the driving transistor DT and the sensing transistor SENT being turned on, to a sensing capacitor Csense of which one side is grounded, so that the sensing capacitor Csense is charged and the sampling voltage Vsam of the sensing node Ns is continuously boosted.

In this way, when the sampling voltage Vsam of the sensing node Ns is boosted, a source voltage of the driving transistor DT is boosted together. Accordingly, the source voltage of the driving transistor DT is increased enough to drive the organic light emitting diode, so that a current starts to flow to the organic light emitting diode.

In order to sense the sampling voltage of the sensing node Ns, a signal level of the sensing signal SENSE is changed to have a low level, so that the sensing transistor SENT is turned off. Accordingly, the standby step is terminated, and the sensing step is started.

Referring to FIG. 22, illustrated is the operation circuit diagram of the sensing step. The ADC of the sensing unit 1710 reads the sampling voltage Vsam of the sensing node Ns therein by turning on the sampling switch SAM in a state in which the sensing transistor SENT is turned off, so that the sensing mode is completed.

Thereafter, the compensation unit 1720 can perform a luminance decrease compensation process by calculating a luminance of each pixel based on the sampling voltage Vsam sensed by each pixel and by supplying, to the repaired pixel, a data voltage (compensation data voltage) obtained by adding a voltage value corresponding to the luminance difference to a data voltage to be supplied to the repaired pixel, in order to compensate for a luminance difference between the repaired pixel and the not-repaired pixel.

As described above, the graph of FIG. 19 illustrates how the luminance of the repaired pixel is compensated according to the sensing process and the luminance decrease compensation process for the repaired pixel.

Figure 23:
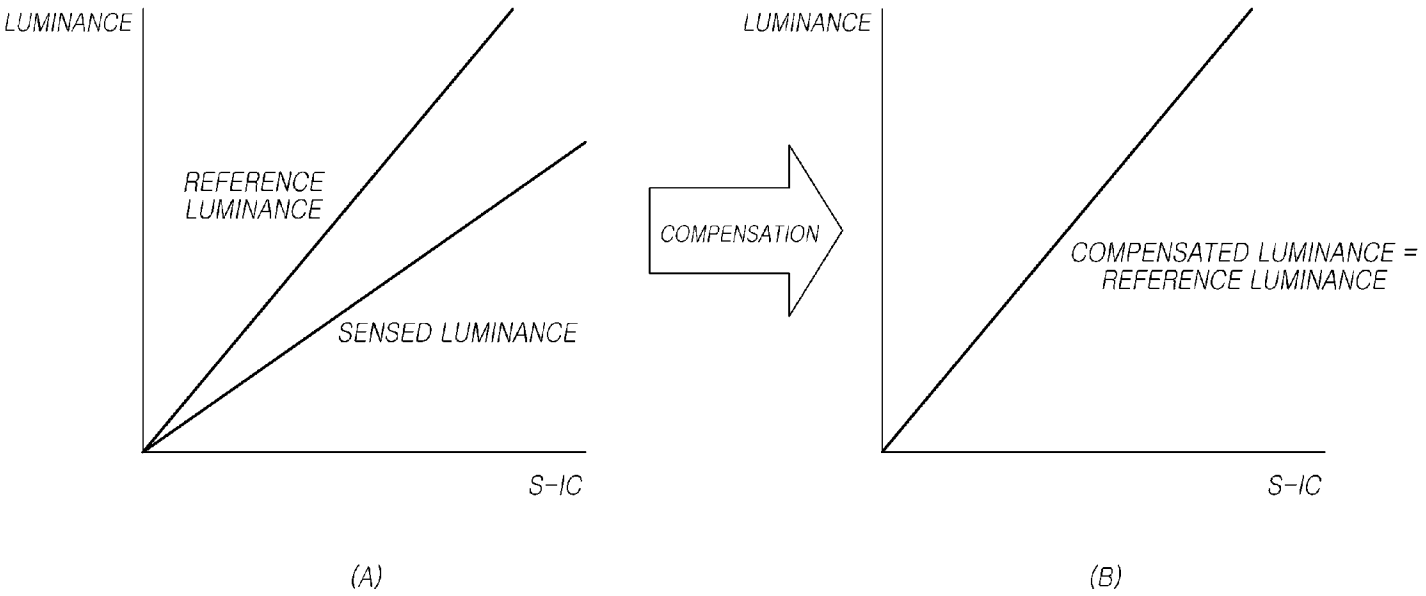
FIG. 23 illustrates graphs depicting luminance according to whether luminance compensation of a repair-processed pixel having a repair transistor structure according to an embodiment or another embodiment is performed in part (B) or not performed in part (A), when a display device is an OLED.

FIG. 23, parts (A) and (B) are graphs depicting luminance according to whether luminance compensation of a repair-processed pixel having a repair transistor structure according to an embodiment or another embodiment is performed or not, in an OLED.

FIG. 23, part (A) is a graph depicting a luminance according to a data voltage supplied from each Source IC (S-IC) for supplying the data voltage and a reference luminance (or a representation of the reference luminance), before the luminance decrease compensation process is performed on the repair-processed pixel, and FIG. 23, part (B) is a graph depicting a luminance according to a data voltage supplied from each Source IC (S-IC) for supplying the data voltage and a reference luminance (or a representation of the reference luminance) after the luminance decrease compensation process is performed on the repair-processed pixel.

For example as illustrated in FIG. 23, part (A), before the luminance decrease compensation process is performed on the repair-processed pixel, the luminance is decreased as compared with the reference luminance.

In contrast, referring to FIG. 23, part (B), after the luminance decrease compensation process is performed on the repair-processed pixel, it can be seen that the luminance which has been decreased according to the repair process is increased to the substantially similar level as the reference luminance. Accordingly, the luminance difference between the repair-processed pixel and the not-repair-processed pixel is also decreased.

In the above, the pixel structure, to which the repair transistor structure according to an embodiment and the repair transistor structure according to another embodiment are applied when the display device 100 is an OLED, has been described.

Hereinafter, the pixel structure, to which the repair transistor structure according to an embodiment and the repair transistor structure according to another embodiment are applied when the display device 100 is an LCD, has been described with reference to FIGS. 24 and 25.

Figure 24:
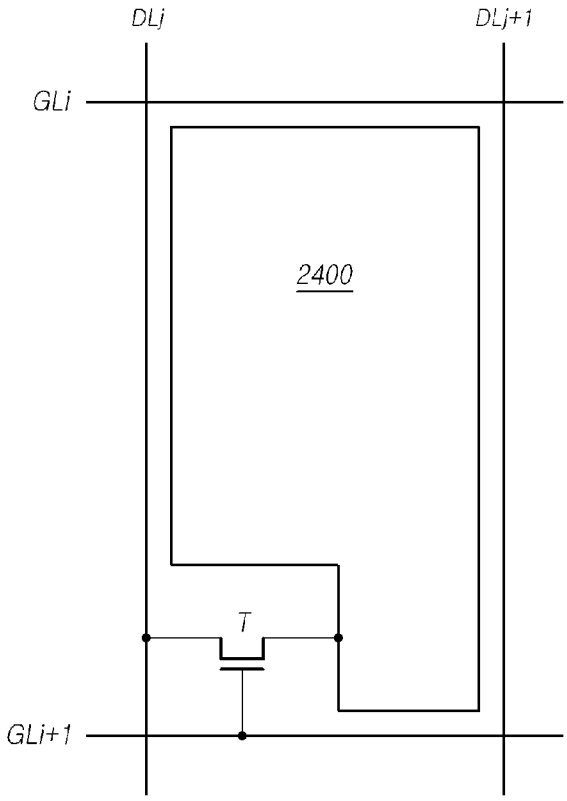
FIG. 24 schematically illustrates a structure of a pixel not having a repair transistor structure according to an embodiment or another embodiment when a display device is an LCD.

FIG. 24 schematically illustrates a structure of a pixel not having a repair transistor structure according to an embodiment or another embodiment when the display device 100 is an LCD.

When the display device 100 is an LCD, a plurality of pixels are defined in the display panel 110 of the LCD according to crossings between a plurality of gate lines GL1 to GLn and a plurality of data lines DL1 to DLm.

FIG. 24 illustrates a pixel structure of a pixel defined by a $i+1^{th}$ gate line $GL_{i+1}$ and a $j^{th}$ data line $DL_j$ and not having the repair transistor structure according to an embodiment or another embodiment. One transistor T may be disposed in such a pixel.

Referring to FIG. 24, a gate node of the transistor T is connected to the gate line $GL_{i+1}$, a source node of the transistor T is connected to the data line $DL_j$, and a drain node of the transistor T is connected to a pixel electrode 2400.

Figure 25:
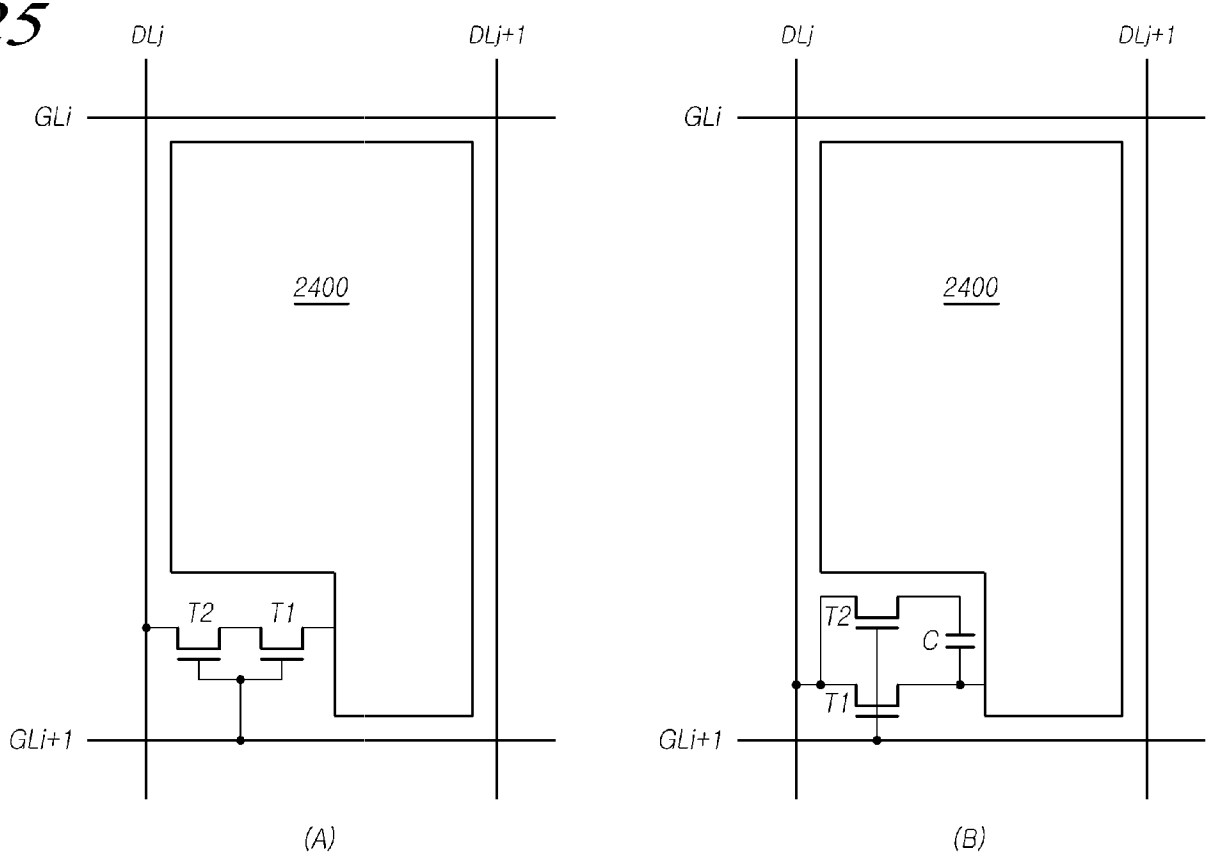
FIG. 25 schematically illustrates a structure of a pixel having a repair transistor structure according to an embodiment or another embodiment when a display device is an LCD.

FIG. 25 schematically illustrates a structure of a pixel having a repair transistor structure according to an embodiment or another embodiment when the display device 100 is an LCD.

Referring to FIG. 25, the first transistor T1 and the second transistor T2 instead of the one transistor T in FIG. 24 are disposed in the repair transistor structure according to an embodiment and another embodiment as illustrated in FIG. 2.

FIG. 25, part (A) illustrates a structure of a pixel to which the repair transistor structure according to an embodiment is applied, where the first transistor T1 and the second transistor T2 are connected to each other in series.

Referring to FIG. 25, part (A), both of gate nodes of the first transistor T1 and the second transistor T2 are connected to the gate line $GL_{i+1}$, a source node of one (in FIG. 25, part (A), the first transistor T1) of the first transistor T1 and the second transistor T2 is connected to the data line $DL_j$, and a drain node of the other one (in FIG. 25, part (A), the second transistor T2) is connected to the pixel electrode 2400.

FIG. 25, part (B) illustrates a structure of a pixel to which the repair transistor structure according to another embodiment is applied, and in FIG. 25, part (B), the first transistor T1 and the second transistor T2 are connected to each other in parallel.

Referring to FIG. 25, part (B), both of the gate nodes of the first transistor T1 and the second transistor T2 are connected to the gate line $GL_{i+1}$. Both of the source nodes of the first transistor T1 and the second transistor T2 are connected to the data line $DL_j$. The drain node of the second transistor T2 is coupled to the pixel electrode 2400 through a capacitor C, and a drain node of the first transistor T1 is coupled to the pixel electrode 2400 directly. A source node of the second transistor T2 is coupled to the data line DL through another capacitor C.

The repair process for the pixel exemplified in FIG. 25, parts (A) and (B) is performed similar to the aforementioned scheme.

As described above, in accordance with the present invention, the display device 100 having the repair structure (the repair transistor structure) which makes a defective pixel operate as a normal pixel is provided.

Further, in accordance with the present invention, the display device 100, in which a luminance of the defective pixel is compensated after the repair process which makes the defective pixel operate as a normal pixel, is provided.

The above descriptions and the above accompanying drawings merely exemplarily illustrate the technical spirit of the present invention, and those skilled in the art to which the present invention pertains can make various modifications and variations such as combination, separation, substitution and change of the configuration without departing from essential characteristics of the present invention. Therefore, the embodiments disclosed in the present invention are intended to illustrate the scope of the technical idea of the present invention, and the scope of the present invention is not limited by the embodiment. The scope of the present invention shall be construed on the basis of the accompanying claims in such a manner that all of the technical ideas included within the scope equivalent to the claims belong to the present invention.

What is claimed is:

1. A display device comprising:

a display panel in which a plurality of pixels in which a data line and a gate line are formed are defined;

a data driving unit configured to supply a data voltage to the data line; and a gate driving unit configured to supply a scan signal to the gate line, wherein a pixel from the plurality of pixels includes:

a first transistor;

a second transistor;

a first welding pattern spaced apart from at least one of a source node and a drain node of the first transistor; and a second welding pattern spaced apart from at least one of a source node and a drain node of the second transistor.

2. The display device of claim 1, wherein a gate node of the first transistor and a gate node of the second transistor are connected to each other, and the source node or the drain node of the first transistor and the drain node or the source node of the second transistor are connected to each other, so that the first transistor and the second transistor are connected to each other in series.

3. The display device of claim 2, wherein the first transistor and the second transistor are connected to each other in series and perform a switching operation together.

4. The display device of claim 1, wherein the pixel comprises a connection pattern for connecting the source node and the drain node of one of the first transistor and the second transistor.

5. The display device of claim 4, wherein the connection pattern is formed by welding one of the first welding pattern and the second welding pattern, and one of the first transistor and the second transistor performs a switching operation.

6. The display device of claim 4, further comprising a compensation circuit unit configured to compensate for a luminance decrease of the pixel due to the connection pattern.

7. The display device of claim 1, wherein the display device is an Organic Light Emitting display (OLED), the pixel further comprises a driving transistor for driving an organic light emitting diode and a switching transistor for transferring a voltage to a gate node of the driving transistor, and at least one of the driving transistor and the switching transistor comprises the first transistor and the second transistor for a repair process.

8. The display device of claim 1, wherein the display device is a Liquid Crystal Display (LCD), and the pixel further comprises a pixel electrode coupled to the data line in series with the first transistor and the second transistor, and both of gate nodes of the first transistor and the second transistor are connected to the gate line.

9. A display device comprising:

a display panel in which a plurality of pixels in which a data line and a gate line are formed are defined;

a data driving unit configured to supply a data voltage to the data line; and a gate driving unit configured to supply a scan signal to the gate line, wherein a pixel from the plurality of pixels comprises:

a first transistor;

a second transistor; and a welding pattern, and wherein a drain node of the first transistor is coupled to a drain node of the second transistor, and a source node of the first transistor is coupled to a source node of the second transistor, and the welding pattern is coupled to the second transistor in series to disable current to flow through the second transistor.

10. The display device of claim 9, wherein the welding pattern is formed at the drain node or the source node of the second transistor.

11. The display device of claim 9, wherein the welding pattern is a capacitor.

12. The display device as claimed in claim 9, wherein at least the drain node and the source node of the first transistor is cut, and a connection pattern is formed on the welding pattern to enable the second transistor to conduct current.

13. The display device as claimed in claim 12, wherein the connection pattern is formed by welding the welding pattern.

14. The display device as claimed in claim 9, wherein a size of the second transistor is smaller than a size of the first transistor.

15. The display device as claimed in claim 9, wherein the data driving unit supplies a data voltage compensated according to a size difference between the first transistor and the second transistor, to the pixel.

16. The display device as claimed in claim 9, wherein the display device is an OLED, the pixel further comprises a driving transistor for driving an organic light emitting diode and a switching transistor for transferring a voltage to a gate node of the driving transistor, and at least one of the driving transistor and the switching transistor comprises the first transistor and the second transistor for a repair process.

17. The display device as claimed in claim 9, wherein the display device is an LCD, the pixel further comprises a pixel electrode coupled to the data line in series with at least one of the first transistor, and the second transistor and the welding pattern, the first transistor and the second transistor are coupled in parallel, and both of gate nodes of the first transistor and the second transistor are connected to the gate line.

* * * * *